United States Patent [19]

Seaborn

[11] Patent Number: 4,535,567

[45] Date of Patent: Aug. 20, 1985

[54] COMPUTER MAGNETIC MEDIA BURNISHER

[75] Inventor: Paul E. Seaborn, Los Gatos, Calif.

[73] Assignee: Seaborn Development, Inc., San Jose, Calif.

[21] Appl. No.: 526,966

[22] Filed: Aug. 26, 1983

[51] Int. Cl.[3] ..... B24B 21/00

[52] U.S. Cl. ..... 51/140; 51/145 R; 51/154; 51/161; 51/324

[58] Field of Search ..... 51/324, 145 R, 140, 51/154, 161

[56] References Cited

U.S. PATENT DOCUMENTS

| | | | |
|---|---|---|---|
| 3,253,824 | 5/1966 | Southwell et al. . | |
| 3,465,481 | 9/1969 | Szwarcman | 51/324 |
| 3,943,666 | 3/1976 | Dion et al. | 51/106 |
| 4,179,852 | 10/1979 | Barnett | 51/132 |
| 4,330,910 | 5/1982 | Schachl et al. | 29/90 |
| 4,347,689 | 9/1982 | Hammond | 51/145 R |
| 4,412,400 | 11/1983 | Hammond | 51/58 |

FOREIGN PATENT DOCUMENTS

| | | |
|---|---|---|
| 0057859 | 8/1982 | European Pat. Off. . |
| 0083753 | 7/1983 | European Pat. Off. . |

OTHER PUBLICATIONS

IBM Technical Disclosure Bulletin, vol. 21, No. 9, Feb. 1979, G. S. Pal, "Integrated Burnish and Glide . . . Disk Process", pp. 3761-3762.

IBM Technical Disclosure Bulletin, vol. 19, No. 10, Mar. 1977, N. E. Slindee, "Burnishing Method and App. for Flexible Magnetic Disks", pp. 3829-3830.

*Primary Examiner*—Frederick R. Schmidt
*Assistant Examiner*—J. T. Zatarga
*Attorney, Agent, or Firm*—Townsend & Townsend

[57] ABSTRACT

A floppy disk burnishing and packaging machine and method including pick up, burnishing, packaging and collection assemblies. A transfer mechanism moves disks between the various assemblies and a control system coordinates the operation in each so that processing proceeds simultaneously in each according to a particular sequence. Disks are removed from a supply stack one at a time with part of that process involving curling the peripheral edge of the topmost disk upwardly away from the stack. The burnisher includes air knife hold down devices to force the disks against burnishing rolls over which burnishing tapes are moved. The air knife devices also cause a slight amount of wrapping between the disks and the burnishing rollers to increase the burnishing area. Further, the disk is oscillated during burnishing, relative to the burnishing rolls, to improve burnishing. Burnished disks are automatically packaged in protective jackets which are ejected and collected.

5 Claims, 29 Drawing Figures

Fig. 11
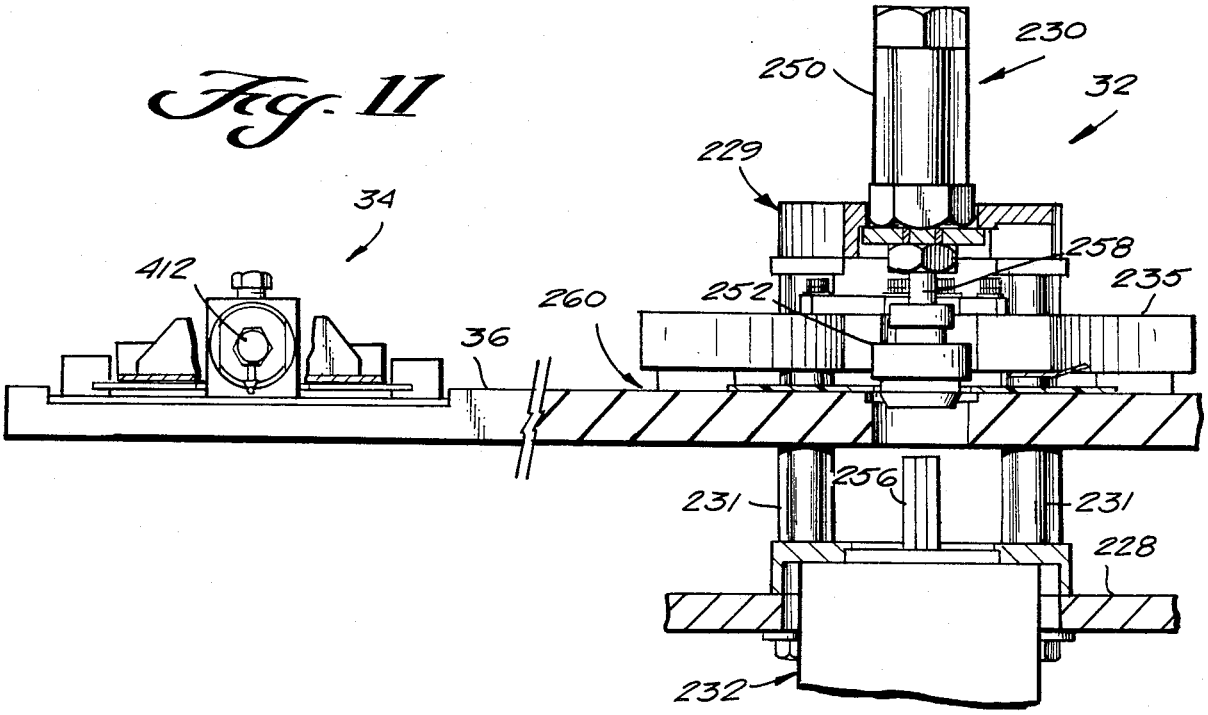
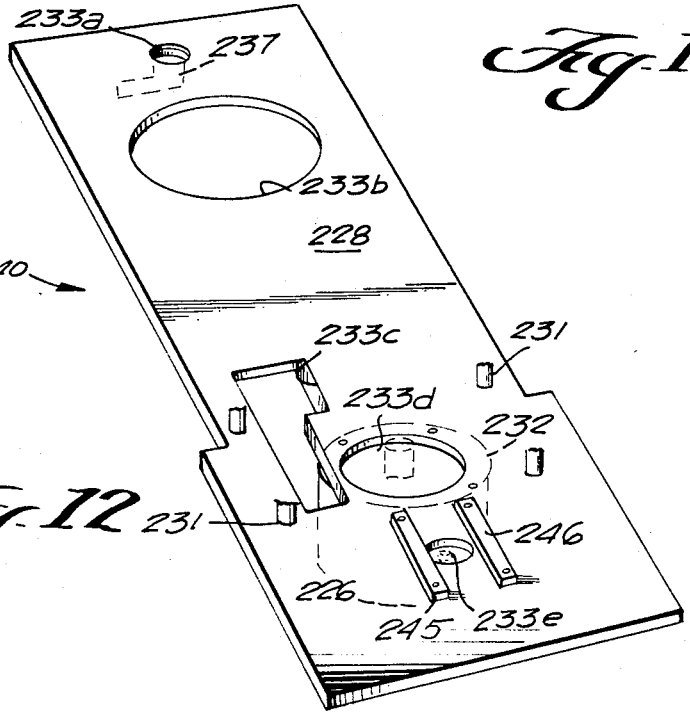
Fig. 12
Fig. 13
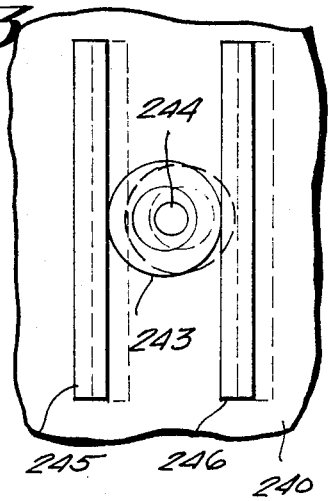

Fig. 16
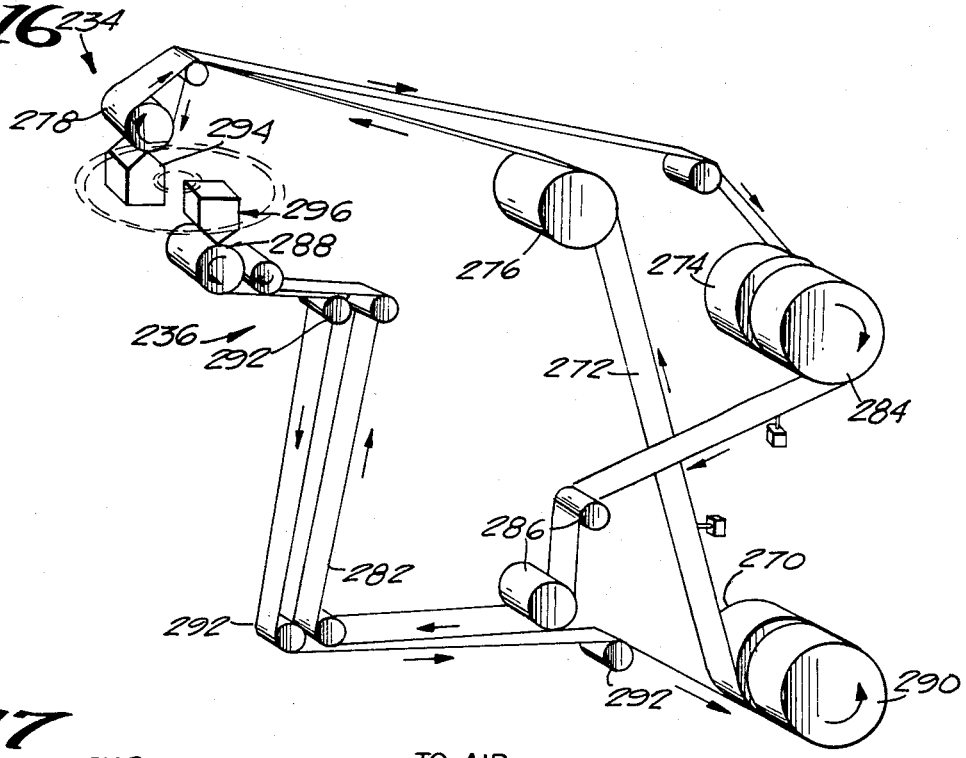
Fig. 17
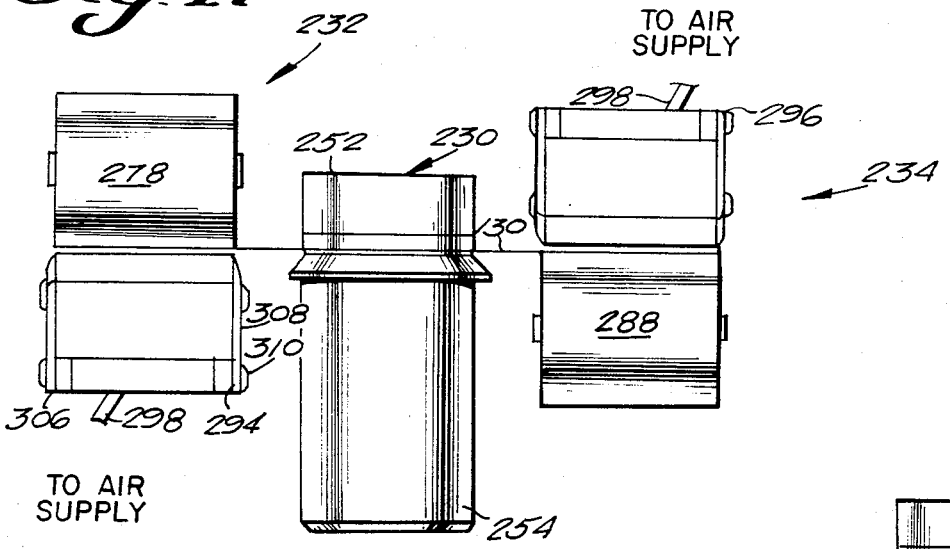
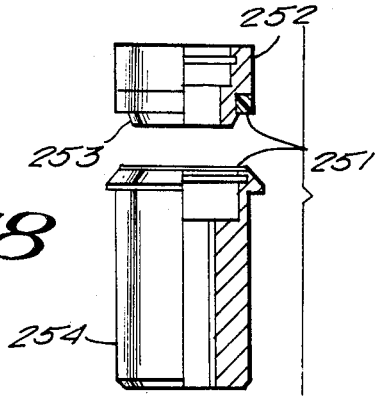
Fig. 18

COMPUTER MAGNETIC MEDIA BURNISHER

FIELD OF THE INVENTION

This invention relates to an automatic system for burnishing both sides of a floppy disk and for automatically stuffing the burnished disk into a protective user jacket.

BACKGROUND OF THE PRESENT INVENTION

Prior to the present invention there was no single machine that provided a coordinated, systematic approach for burnishing floppy disks simultaneously on each side and therafter stuffing the burnished disk. directly into a protective jacket. Rather, individual disks were hand-fed into burnishing equipment, where one side and then the other was burnished, a slow time-consuming operation. Thereafter, individual disks were placed into protective jackets.

Floppy disks can be conveniently provided in a stacked form of a plurality of individual disks. Disks are conventionally formed from mylar sheeting coated with a very thin, magnetic oxide layer. However, the smoothness required for final operability of that oxide coating does not exist at the time the coating is applied, and various surface irregularities must be smoothed or removed by buffing. Such smoothing and polishing is required so that subsequently applied recording heads will not bounce along the surface or otherwise track improperly all of which would diminish an acceptable recording or playback result. In other words, the sensitivity of the recording surface must be polished to a very smooth condition and this is what the burnishing process will accomplish.

One of the problems of providing appropriate burnishing is to accurately and consistently remove only single disks from such a stack, that is, one disk at a time. Because disk surfaces prior to the final polishing are relatively smooth and because of static electricity that can build up between disks, relatively great attractive forces can be created between individual disks that tend to hold several disks together as a group or unit. Thus, when trying to pick one from the top of any stack, two or more might easily be removed. In a burnishing operation where both sides are being simultaneously burnished, especially an automatic one, that is not desirable.

Perforated rolls to which a vacuum is applied, have been used for some time in feeding individual sheets of paper into various types of equipment such as copying machines. For example, the Kodak Model Ektaprint 150 copying machine employs a vacuum roll to pull sheets from the bottom of a stack. The roll is provided with a plurality of squared apertures extending along that roll. The stack of paper is on top of the vacuum roller with the edge of the paper being supported out over that roller so that when vacuum is applied, the edge of the bottommost sheet overlying the vacuum roll would be drawn into the surface of that roll ahd subsequent partial rotation of the roller will usually initiate removal of the bottom sheet of paper from the stack.

Another example of a roller pick up assembly is shown in Southwell et al, U.S. Pat. No. 3,253,824, where the use of a rotatable pick up element is disclosed, specifically in FIGS. 12*a*–12*c*, with the surface of that roll being roughened or covered with sandpaper, sponge, foam rubber or plastic and designed primarily to pick up a single layer of textile fabric.

SUMMARY OF THE PRESENT INVENTION

The present invention, an automatic disk burnisher and disk packing machine, is comprised of an outer frame or stand, various motors and drive cylinders, and a disk supply assembly for holding a stack of individual disks and providing disks a desired level by continuously raising the stack as disks are removed therefrom. The machine also includes a disk pick off assembly which removes individual disks from the disk supply, a burnishing assembly, a jacket stuffing assembly and a movable carriage assembly. The carriage mechanism is slidably mounted to the frame and moves disks between the supply, burnishing and jacket stuffing assemblies. Further, a discharge mechanism can be employed at the end of the device adjacent the stuffing assembly for receiving and conveniently collecting the jacketed disks.

A variety of vacuum sensing switches together with timers and limit or micro switches are used throughout the device to provide, in a conventional manner, input data for a programmable controller, such as a Gould Modicon Micro 84 (2000 bite) controller, which senses where pieces of equipment are, when disks are properly moved and in the desired positions by sensing the presence or absence of vacuum, and likewise when the processing sequences involved can be initiated or stopped. Thus, carriage movement, the various disk pick ups, disk transfer, burnishing and jacket stuffing phases will occur in a desired and preset sequence, one to the other, with all processing steps being coordinated. With this control capability, a single disk is being prepared for removal from the stack at the same time another disk is being burnished while the disk just previously burnished is retained at a holding location prior to being placed in a jacket. The jacketing of that disk will occur upon the next indexing stroke or movement of the carriage assembly which also removes the captured single disk from the supply stack and moves it into the burnishing assembly while simultaneously moving the just burnished disk to the holding position for stuffing into a jacket on the next carriage stroke.

When the burnishing cycle has been completed for a disk, which occurs in approximately four seconds, the next individual disk will have been readied for removal from the stack and a separate vacuum pick up of the transfer assembly positioned at the burnisher station will again engaged the disk which has just been burnished. At this point, the carriage is indexed toward the jacket stuffing assembly. The disk which had been at the holding point will also have been engaged by a vacuum pick up arm connected to the carriage assembly prior to carriage movement so that as the carriage moves, the various disks, the one at the supply stack, the burnisher and at the holding point will each be indexed to their next successive station. That is, the disk at the supply stack is moved to the burnishing station, the disk that was at the burnishing station is moved to the jacket stuffing holding position, and the disk previously held at that point is stuffed into a jacket and the jacketed disk discharged. Following jacket stuffing and discharge, each disk will be released and the carriage will move back to its initial or home position where the pick up assembly will again be positioned over the supply stack of disks. At this point, pick up procedures will again simultaneously proceed together with burnishing and the next jacket will be moved into position and readied for receiving the disk thus being held at the holding position.

Other objects, features, and characteristics of the present invention, as well as the methods and operation and functions of the related elements of the structure, and to the combination of parts and economies of manufacture, will become more apparent upon consideration of the following detailed description and the appended claims with reference to the accompanying drawings, all of which form a part of this specification, wherein like reference numerals designate corresponding parts in the various figures.

BRIEF DESCRIPTION OF THE DRAWINGS

FIG. 11 is an elevational view with portions and sections for clarity of the burnishing assembly taken along line 11—11 of FIG. 2;

FIG. 12 is a perspective view of the oscillatable burnishing plate;

FIG. 13 is a diagrammatic fragmentary view of the eccentric drive for the burnishing plate;

FIG. 16 is a diagrammatic view of the burnishing tape feed system;

FIG. 17 is a diagrammatic side elevational view of the burnishing clamp and hold down assemblies;

FIG. 18 is a diagrammatic, cross-sectional view of the burnishing holding clamp with portions being shown in crosssection for clarity;

DETAILED DESCRIPTION OF THE PREFERRED EXEMPLARY EMBODIMENT OF THE PRESENT INVENTION

The present invention deals with an automated multi-component system for taking stored floppy disks, one at a time, from a supply stack of a plurality of individual disks. Each disk will be simultaneously burnished on both sides and then automatically stuffed into a separate protective jacket or envelope.

Figure 1:
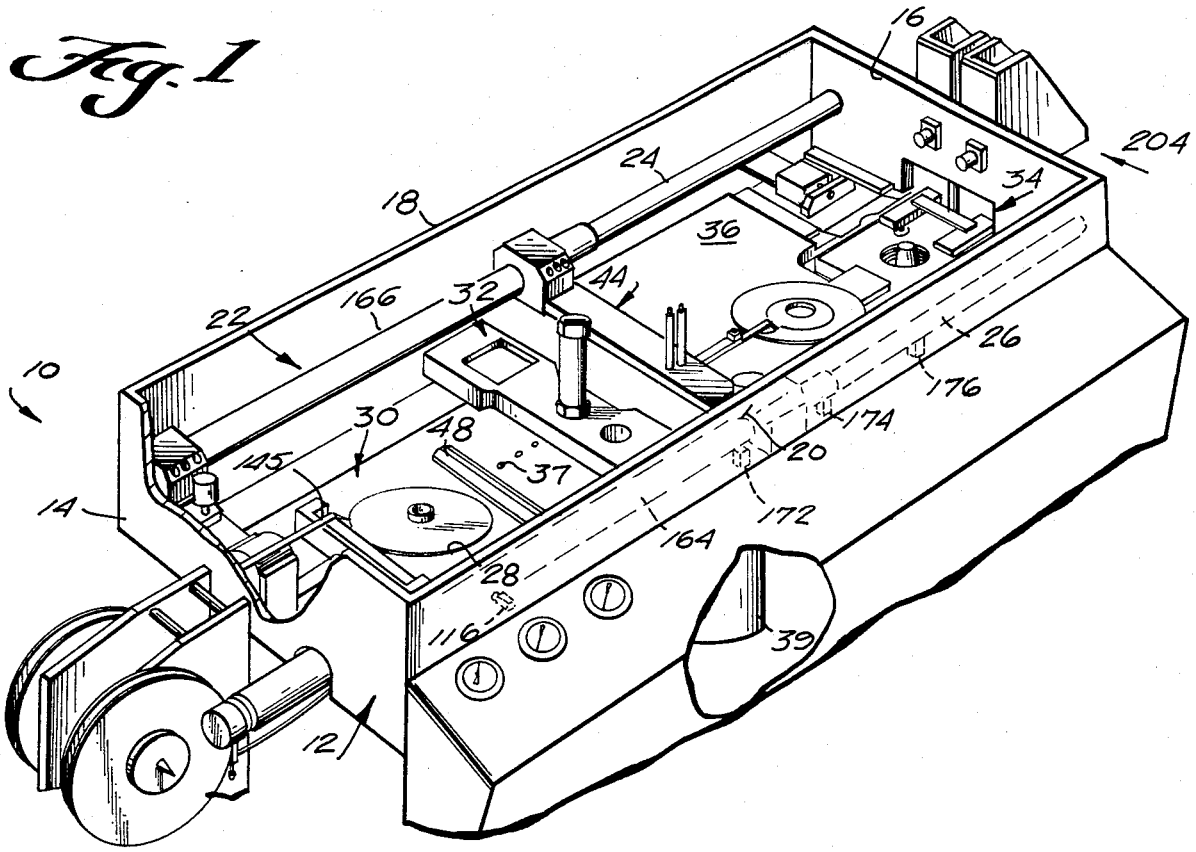
FIG. 1 is a diagrammatic perspective view of the device.

The machine, generally indicated at 10 in FIG. 1, is comprised of an outer frame 12, which is usually covered with protective covers, and the primary components include opposing end walls 14 and 16, and opposing side frame members 18 and 20.

The carriage assembly, generally indicated at 22, moves along guide and support rails 24 and 26 each respectively positioned along opposite sides of the machine and within the frame structure. Included as part of the carriage assembly 22 is a pick up assembly 30 at one end of the machine which is connected to a transfer assembly 44 by suitable connectors so that both move as an integral unit. The pick up assembly overlies a storage well 28 for holding a supply of a plurality of disks, when carriage assembly 22 is in its rear, home or start position. The transfer assembly 44 lies adjacent the burnishing assembly 32 when the carriage assembly 22 is in its rear position and a jacket stuffing assembly 34 is located at the other end of the machine from the pick up assembly 30.

PICK UP ASSEMBLY

The pick up, burnishing and jacket stuffing assemblies, as well as storage well 28, are all supported by or on a primary support plate or deck 36 connected by any convenient means to the frame as well as end and side panels 14–20. Deck 36 can be provided with a series of centrally positioned air holes 37 between the burnishing station and the supply and holding positions, respectively, to help move the disk by floating them. If other air flows are sufficient, air flow from such holes or the holes themselves may be eliminated. Further, when the disk is in its holding position following burnishing but prior to being placed in a protective user jacket, it is preferably held down onto deck 36 by a series of vacuum holes provided in deck 36 as indicated at 46 in FIG. 2. Vacuum can be supplied to these holes via suitable tubing (not shown) from a vacuum source, such as a vacuum pump 39 provided within the device, with the timing of the application of vacuum being simultaneous with the carriage assembly's completion of its full stroke at the jacket stuffing end of the device. At that point a disk will have been moved from the burnishing station to the hold position and released by the transfer assembly 44. Additionally, returning to FIG. 2, two elongated slots 38 and 40 are provided in deck 36 with the depending drive arm 42 of the pick up assembly 30 extending within and operating along slot 38. Drive arm 42 will be connected to a crank arm 41 of the carriage drive motor 43 by a drive arm 45 which together provide the drive linkage and means for carriage assembly 22.

Drive arm 45 is comprised of an outer tubular member 47 fixed to arm 42 and an inner shaft 49 fixed to crank arm 41. These two members, tube 47 and shaft 49 slide together and are held in a fixed position by a spring controlled ball-detent arrangement 51. Two sensing microswitches 53 and 55 are positioned on opposite sides of the ball detent device 51 and serve to sense when the force of either pushing the carriage assembly 22 away from its home position or pulling it back toward its home position is in excess of that normally required to move the carriage, and fixed by the ball-detent arrangement 51. Should the force of the spring be overcome by something being in the way of carriage movement, one or the other of switches 53 or 55, which are connected in series and are normally closed, will open as shaft 49 moves. Should this occur, the machine will immediately stop. In operation, prior to the carriage drive motor 43 being actuated, the pick-up assembly must have completed its pick-up sequence and the transfer assembly must have confirmed pick ups of the disks at the burnishing and holding positions as will be more fully explained hereinafter.

Storage well 28 is positioned approximately half way between slots 38 and 40 and is spaced away from end panel 14 by a distance that will allow the positioning of pick-up assembly 30 to be directly over the rear portion of the disks when carriage assembly 22 is in its rearmost or start position.

As will become more clear hereinafter, air exiting from the air knife hold down devices in the burnisher will flow along the upper surface of deck 36 toward both the supply of disks in well 28 and toward the jacket stuffing area at the opposite end of the device. In order to minimize the effect of that air flow on the stack of supply disks, an air dam 48 is positioned across deck 36 between the burnisher and the disk supply well 28, preferably directly adjacent well 28. The side toward well 28 is beveled and the exterior surfaces are smoothed so that disks can easily move over air dam 48. While the side of air dam 48 facing the burnishing station may also be beveled, it would not need to be.

With reference now to FIGS. 2, 3 and 8*a*–8*c*, disk pick up assembly 30 can be described.

Figure 3:
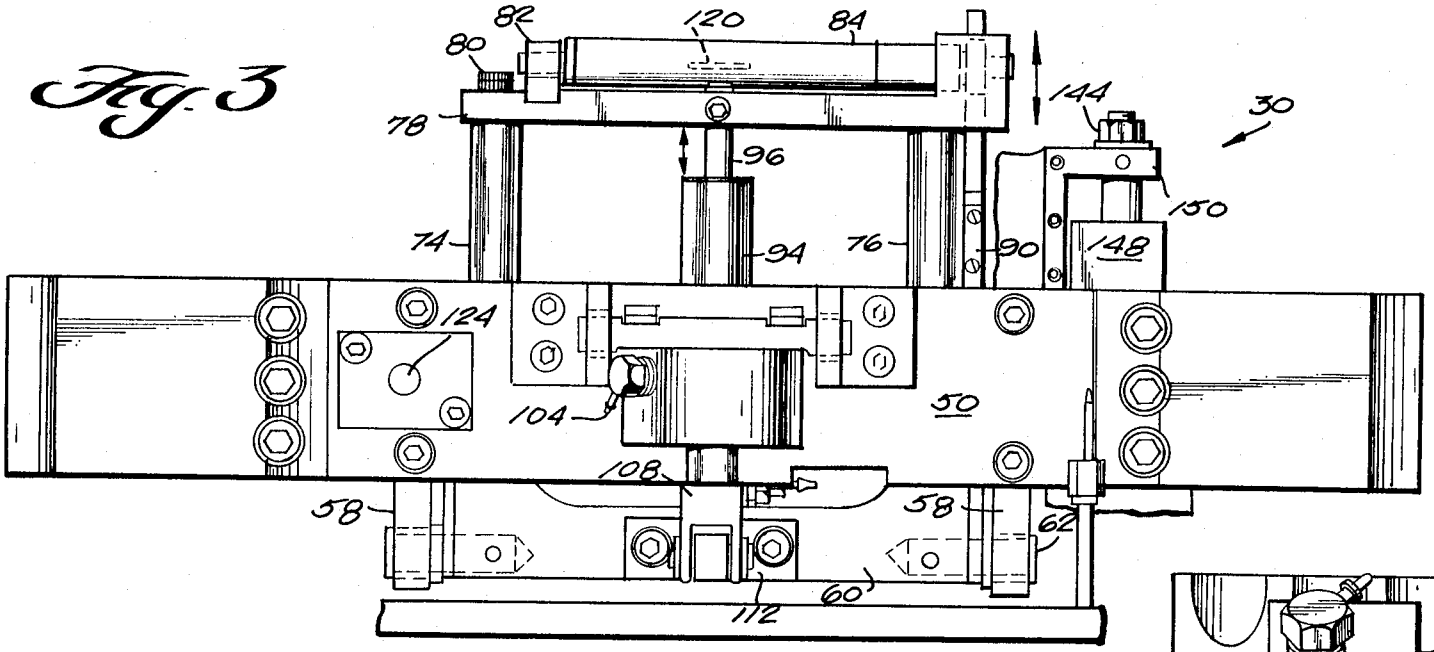
FIG. 3 is a top plan view of the pick-up assembly.

Pick up assembly 30 is specifically comprised of a support panel 50, as shown in FIG. 3, on which rail mounts 52 and 54 are provided with these rail mounts being secured to the rails by bolts 56 so that the positioning of the pick-up assembly 30 on the carriage assembly 22 can be adjusted. Once adjusted, however, the position of pick-up assembly 30 will remain fixed.

Figure 6:
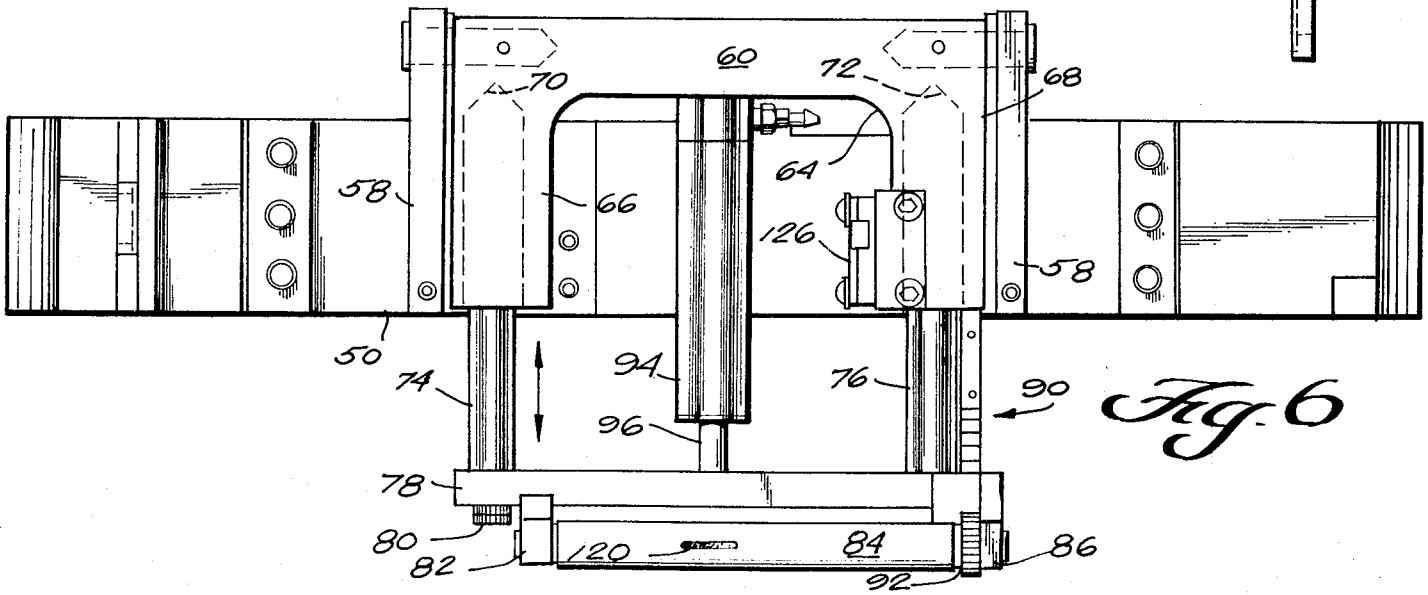
FIG. 6 is a bottom plan view of the pick-up assembly as shown in FIG. 4.

A pair of mounting brackets 58 extend outwardly behind the rear portion of panel 50, as shown in FIGS. 3 and 6. Pins 62 extend through the rear portion of brackets 58 and pivotally support a plate 60. Plate 60 has a U-shaped center opening 64, as in FIG. 6, which opens frontwardly and defines a pair of arms 66 and 68, each of which has a tubular opening therein, indicated at 70 and 72, respectively. Openings 70 and 72 will slidably receive tubular members 74 and 76 which are joined at their outer ends by means of a front support plate 78 secured to each by bolts 80.

A bracket 82 is provided on one side of plate 78 and constitutes a rotating mount for one end of a hollow pick-up roller 84, with the other side of pick-up roller 84 being rotatably mounted in a depending arm 86 at the opposite end of plate 78.

Figure 4A:
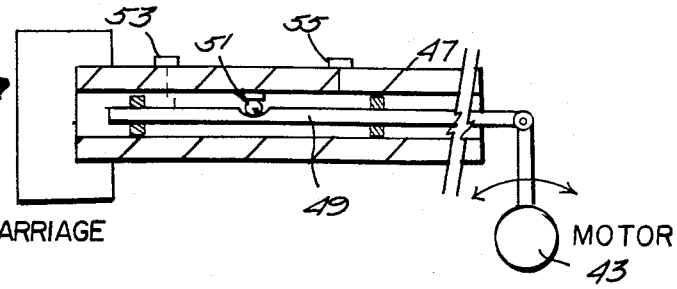
FIG. 4*a* is a diagrammatic representation of the drive arm system of the carriage assembly.
Figure 4:
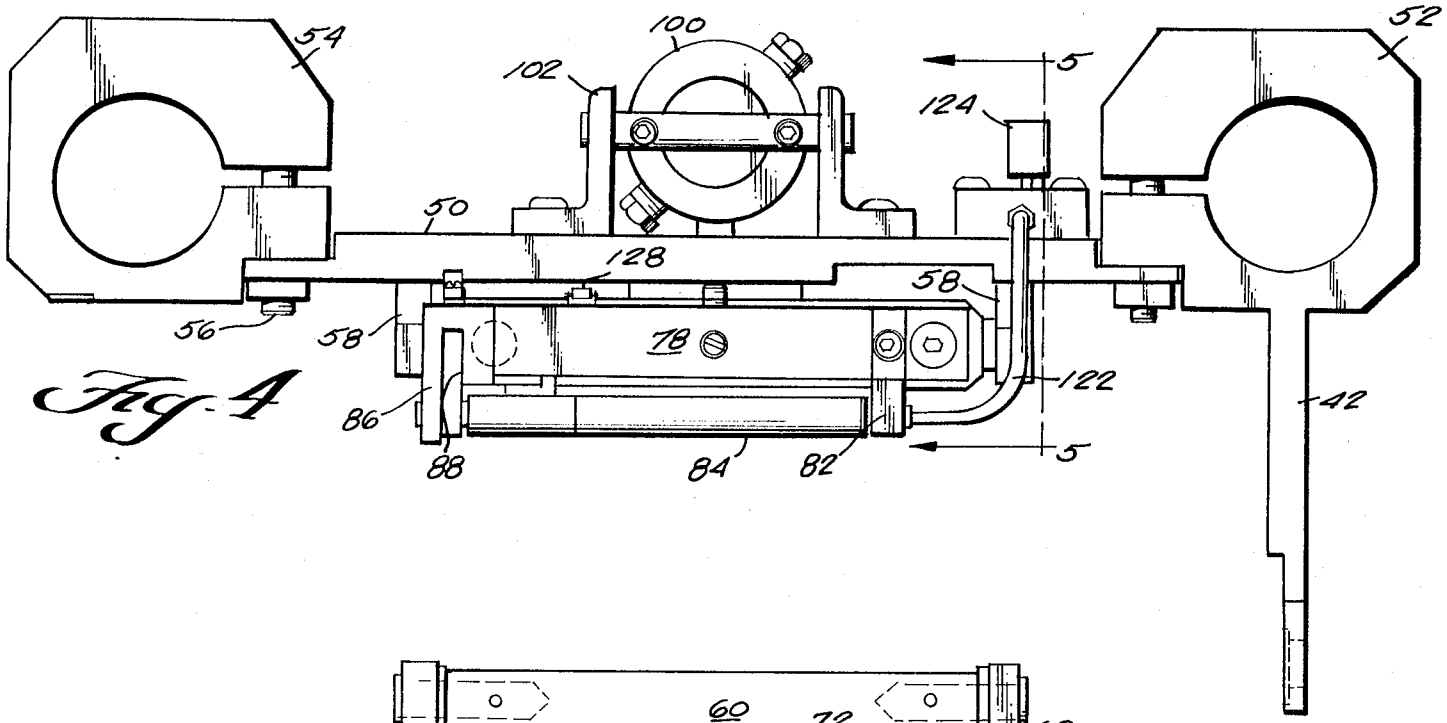
FIG. 4 is a diagrammatic, elevational view from the front of the pick-up assembly.
Figure 8A:
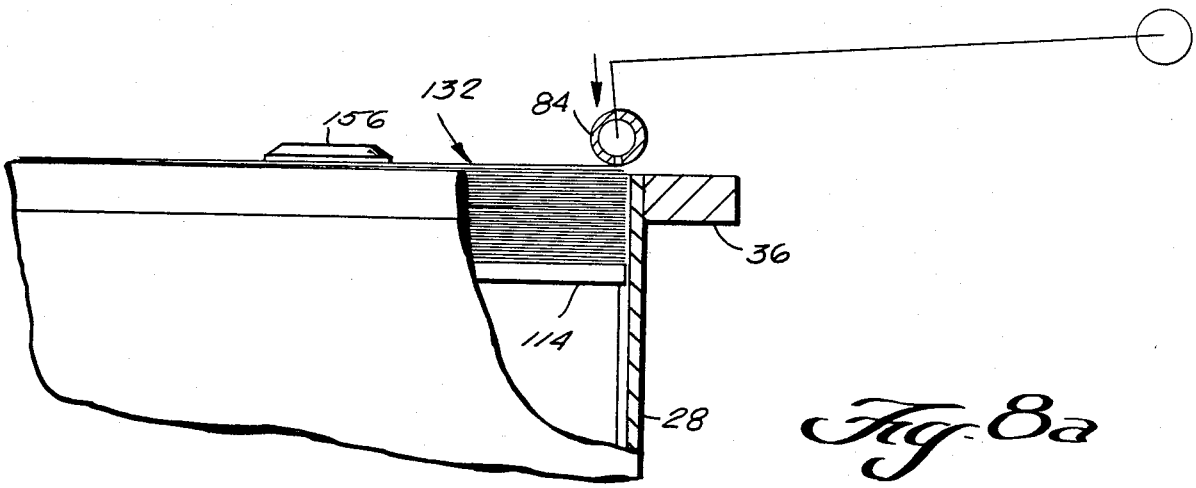
FIGS. 8*a*–8*c* are diagrammatic views of the pick-up sequence.
Figure 8B:
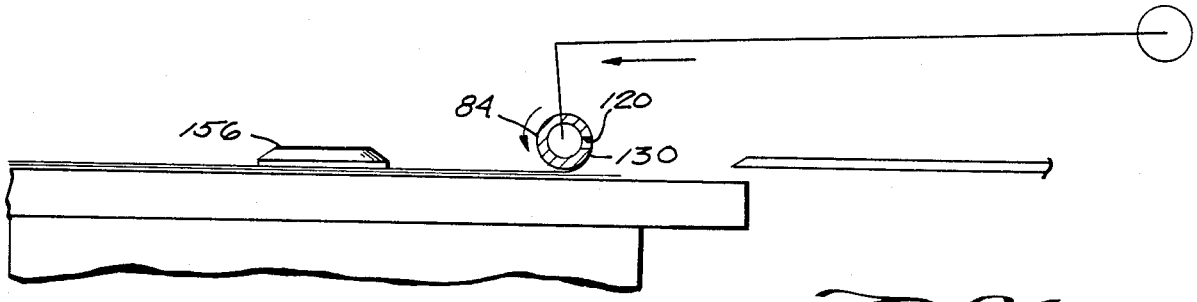
Figure 8C:
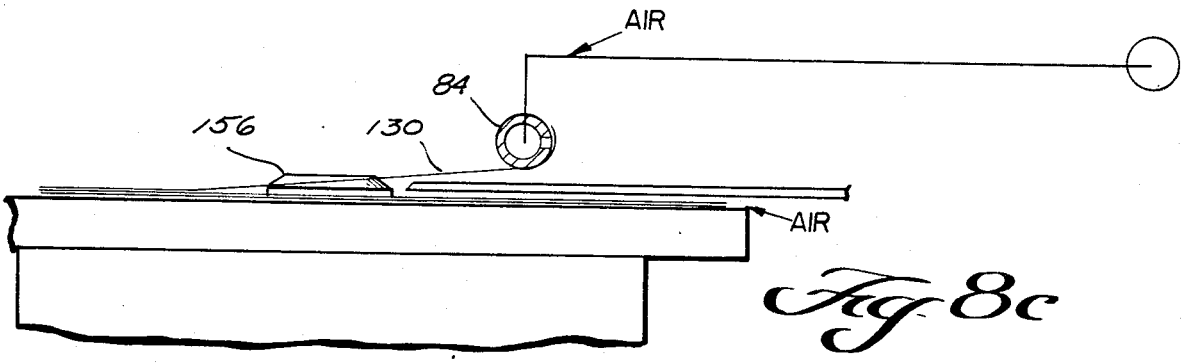

As shown in FIG. 4, that other end of plate 78 is also provided with means defining a U-shaped opening 88 in which a rack 90, separately secured to plate 50, can move. A pinion gear, 92, is secured at the end of roller 84 within opening 88 so as to engage rack 90. An air cylinder 94, having a drive arm 96, extends between plates 60 and 78 and when drive arm 96 is extended, tubes 74 and 76 will slide within openings 70 and 72. Since rack 90 is fixed to plate 50, the relative movement of plate 78 and rack 90 and, thus, of pick-up roller 84 will rotate pinion gear 92 and, accordingly, pick-up roller 84. Such rotation is shown in FIGS. 8*a*, 8*b* and 8*c* with the rotation of pick-up roller 84 being counter-clockwise as 78 is moved away from plate 50 and clockwise as it is moved back toward plate 50.

A narrow and elongated slot 120 as provided in pick-up roller 84 leading to the roller's hollow interior and it is this slot that vacuum will act to pull the top disk toward and hold that disk against roller 84. Slot 120 is approximately 0.080 inches wide and approximately 0.700 inches long. A circular opening will not function correctly to allow the vacuum to pick up only a single disk as it will cause the formation of a cup-like structure the disk that will create its own suction and lift the next lower disk or two as well.

It must be understood that while the oxide coated mylar material from which floppy disks are made is relatively smooth, it is not yet smooth enough prior to burnishing for direct use with recording equipment. Nonetheless, attractive forces due to that smoothness and also due to static electricity as well as other factors will tend to hold individual disks next to one another. Thus, the lifting of the top most disk in a given stack could often result in the removal more than a single disk. This, of course, is not desirable for burnishing purposes.

The pick-up assembly 30 has been designed so that it will consistently remove only the topmost disk from the stack.

The removal process begins with the carriage assembly 22 in its normal or returned rear position as shown in FIG. 1. When in that position, cylinder 100 can be actuated to lower pick-up roller 84 down toward and into contact with the topmost disk with the supply stack. When in this position, roller 84 will lie against the rear portion of the stack.

As indicated above, plate 60 is designed to be pivoted with respect to plate 50 and this pivoting action is provided by means of air cylinder 100, mounted to plate 50 by a bracket assembly 102 and a linkage structure. Cylinder 100 has a drive arm 104 connected by a pin 106 and clevis 108 to a vertically depending lever 110, best shown in FIG. 5, which in turn is connected to bracket 112 fixed to the rear of plate 60. As drive arm 104 moves in and out of cylinder 100, plate 60 is pivoted so that roller 84 can be lowered and raised, respectively toward and away from the supply stack of disks located within storage well 28. A microswitch 126 is attached to plate 60, as shown in FIG. 6, and its plunger 128, as shown in FIG. 4, will abut and be actuated by the bottom surface of plate 50. Switch 126 detects the up-down movement of plate 60 and is normally closed when plate 60 is up and roller 84 is raised above the supply stack. Switch 126 is also in series with switches 53 and 55 on the carriage drive arm.

Cylinders 94 and 100 each have respective air inlets and outlets for directing the air flow to appropriately move their drive shafts, 96 and 104, and suitable limit switches could be used with each, if desired, to determine the position of such shafts.

As best shown in FIG. 8*a*, the plurality of individual disks are supported by a plate 114 which is held on and vertically movable along spindle 156. Preferably, the height of the disks is mantained just slighly higher than the top surface of deck 36, by about the thickness of two to three disks, with control of this height being provided by electric eyes, one of which is shown in FIG. 1 at 116. The raising and lowering of plate 114 is conventionally achieved by a motor driven threaded rod or elevator mechanism (not shown but similar to that described for the jacket elevator mechanism) with motor activation in an up direction being controlled by electric eyes 116. Thus, the stack height will be continuously monitored and maintained at the desired level in a similar manner as with the plurality of jackets, described hereinafter. A microswitch could also be provided adjacent the bottom of the supply height mechanism to stop downward movement of the disk supply elevator.

The initial position of engagement between the topmost disk and pick-up roller 84 is shown in FIG. 8*a*. When plate 60 has been pivoted to effect that condition, vacuum will be applied to one end of pick-up roller 84, which is hollow, and consequently to the elongated slot 120 in communication with that hollow interior. Vacuum is developed in a conventional manner, for example, by vacuum pump 39 and is supplied via a vacuum tube 122 which is rotatably connected to one end of pick-up roller 84 and thereby to its interior. The vacuum supply will preferably include a sensor to assure proper vacuum is accumulated in an accumulator (preferably about 22 inches of mercury). Additionally, a vacuum sensor 124 is employed to sense vacuum conditions at roller 84. Vacuum sensor unit 124 will continuously monitor the gripped condition of disk 130 and will sense a pressure change occasioned by the removal of disk 130 from its covering position over slot 120. Suitable conventional timers (not shown) are used to control the down time for roller 84, the roll time and when roll back will occur. However, disk pick up will be confirmed by vacuum sensor 124. The times involved can vary depending upon the amount of burnishing, the type of disks being handled, and operator preferences. Normally, the pick up process will occur in less than 15 seconds.

Slot 120 is arranged to be directly on the bottom of pick-up roller 84 and thus directly against the topmost disk. Because of the design of slot 120, a single disk 130 will be attracted to roller 84 without the formation of a cupped area therein which and shortly after vacuum has been applied to roller 84, cylinder 94 is actuated so that drive arm 96 is moved outwardly.

Actuation of cylinder 94 and further movement of plate 78 causes pinon gear 92 to roll along rack 90 which in turn rotates pick-up roller 84 thereby curling the engaged outer periphery portion of disk 130 in an upward direction away from the next lowermost disk. Pick-up roller 84 is turned through approximately 90 degrees with this condition being shown in FIG. 8*b*. By rotating roller 84 back away from the peripheral edge of the stack of disks, generally indicated at 132, any of the next lower disks below the top most disk 130 which might otherwise might be stuck, engaged or held by static electricity, for example, to that top disk would tend to peel away from disk 130 as roller 84 rotates or while the edge of top disk 130 is at least momentarily held in that curled condition.

Figure 7:
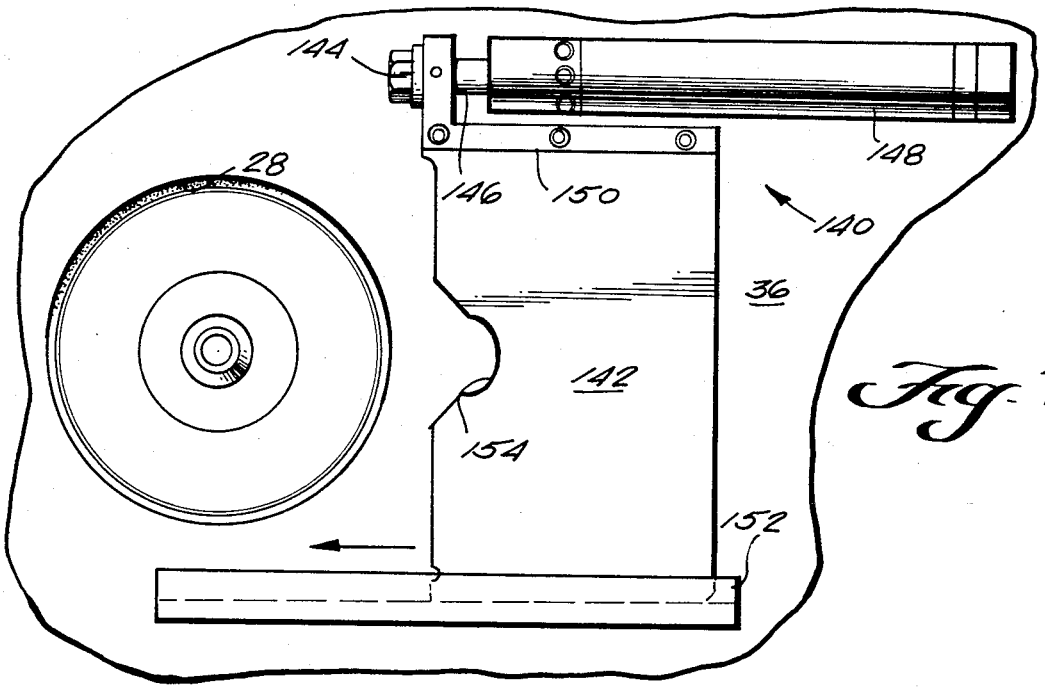
FIG. 7 is a top plan view of the pick-up plate which forms part of the pick-up assembly.

As shown in FIG. 7, a lift off plate assembly, generally indicated at 140, is shown as being comprised of a movable plate 142, one side of which is secured by bolt 144 to the drive arm 146 of an air cylinder 148 via bracket 150. The other side of plate 142 is slidably retained within an edge guide member 152, fixed to deck 36, which guides and supports that other edge. Air cylinder 148 can also be mounted to deck 36.

While it is preferred that forward movement of pick off plate 142 be coordinated with the rolling of pick-up roller 84 as shown in FIG. 8*b* together with the raising of that roller is shown in FIG. 8*c* as well as the rerotation of roller 84 back to the original position as shown in FIG. 8*a*, other sequences of operation can be employed.

Figure 2:
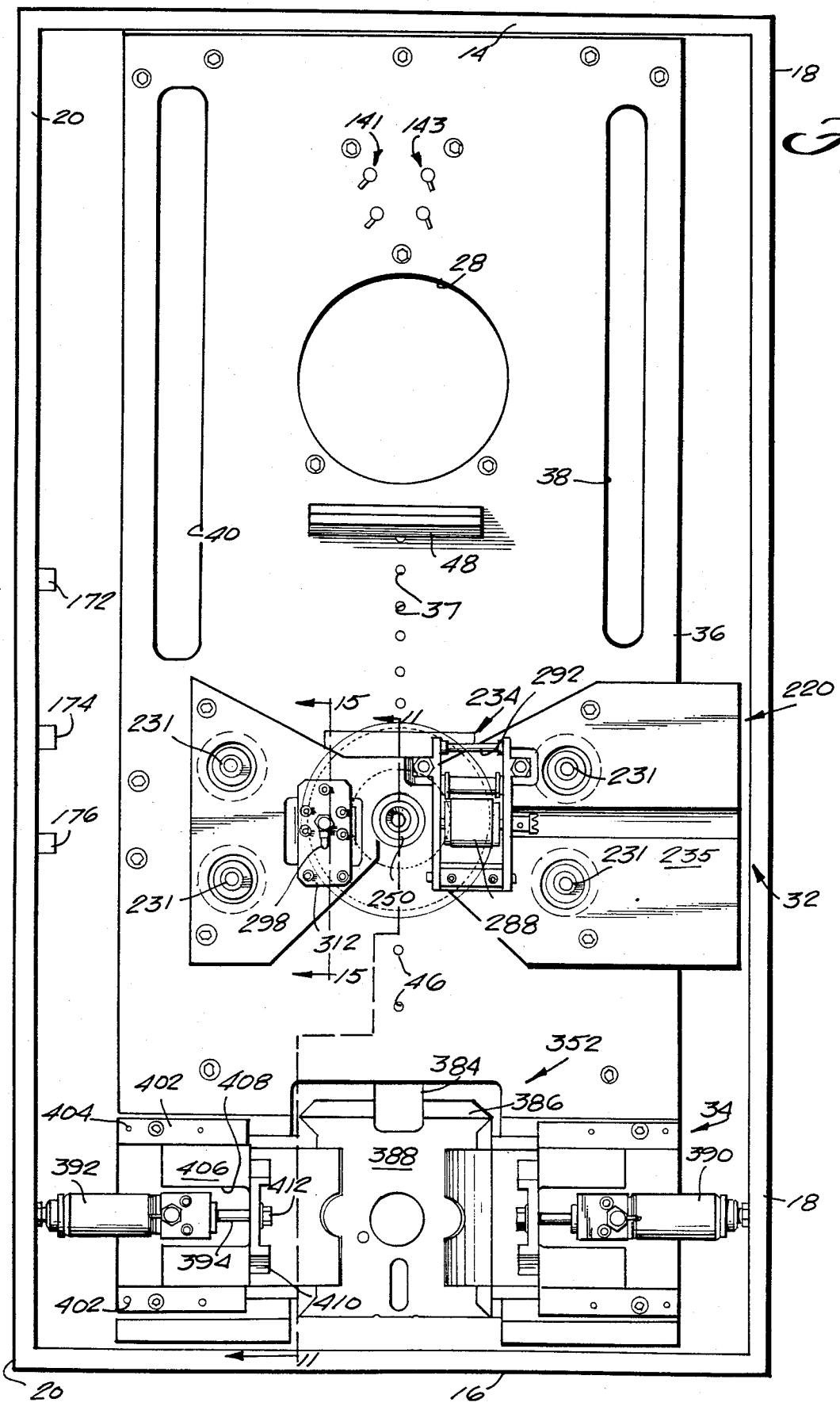
FIG. 2 is a top plan view of the primary support panel showing the pick-up, burnishing, and jacket stuffing assemblies.

I have found that the use of a flow of air from above and below the topmost disk, timed with the movement of pick off plate 142 and the raising of roller 84 works most effectively to remove the top disk from the stack and lift it up over spindle 156 of the disk supply assembly. To accomplish that, two air nozzles 141 and 143, as best shown in FIG. 2, are positioned rearwardly of well 28 on deck 36. The nozzles should be directed generally toward the stack of disks with each directing air toward opposite sides of the disk. Further, an upper air nozzle 145, best shown in FIG. 1 and diagrammatically in FIG. 8*c*, is attached to end wall 14 and will supply an air flow toward the front portion of the disk. Together the air flowing from nozzles 141, 143 and 145 will aid plate 142 in lifting the top disk from the stack and over spindle 156 yet the disk will not be flapping in these air flows but will be held between the effects of the two air flows.

What is important, however, is that following the initial rotation of the rear edge of top disk 130, as shown in FIG. 8*b*, that plate 60 be pivoted up or back to its original position which causes pick-up roller 84 to be lifted, as shown in FIG. 8*c*, allowing pick off plate 142 to be slid thereunder and which also allows air flowing from nozzles 141 and 143 to also pass under the disk. Plate 142 is provided with a cutout 154 which can fit about spindle 156 about which the supply disks are held. The raising of pick-up roller 84 is not sufficient to remove the top disk 130 from the stack 132 but as that cylinder is raised, plate 142 can be slid into the position as shown in FIGS. 8*b* and 8*c*, and its movement toward spindle 156 and the air flows from nozzles 141, 143 and 145 will completely remove the hole within the disk from its position about spindle 156. Preferably, once disk 130 has been removed from the supply stack plate 142 can be left in the position as shown in FIG. 8*c* or moved rearwardly to its start position, and pick-up roller 84 can be rotated back to its initial position as shown in FIG. 8*a* by actuating cylinder 94 to move plate 78 rearwardly back toward plate 50. These functions are preferably controlled by timers actuated when the carriage assembly 22 is back in its home position, switches 53 and 55 are closed and there is tension on the burnishing tapes as will be disclosed hereinafter. Of course, if vacuum loss is sensed by sensor 124 or if pick up roller 84 is not returned to its "up" position as sensed by switch 126 then the system will shut down. At this point disk 130 is ready to be moved into the burnishing station when the carriage assembly is indexed.

CARRIAGE ASSEMBLY

Carriage assembly 22 includes the pick-up assembly 30, as shown in FIGS. 3–6, disk transfer assembly 44 and tubular connecting members 164 and 166. The crank arm drive system is connected through the depending arm 42 on the pick-up assembly 30 as described above with reference to FIG. 4*a*. In particular, rail mounts 52 and 54 for pick-up assembly 30 and rail mounts 160 and 162 for transfer assembly 44 are connected together by tubular mounting members 164 and 166. Rail mounts 52, 54, 160 and 162 allow the position of pick-up assembly 30 and transfer assembly 44 to be moved to correctly locate them and when correct their relative positions will remain fixed. Also the length of members 164 and 166 and the positioning of the pick-up and transfer assemblies are determined by the carriage stroke. Accordingly, pick-up assembly 30 and transfer assembly 44 are joined and move together. While the preferred way to move the carriage assembly 22 is by drive motor 43 and crank arm 41 and drive arm 45 attached to depending arm 42, carriage assembly 22 could be moved by any other desired means, such as, for example, an air cylinder connected to depending arm 42.

Figure 1A:
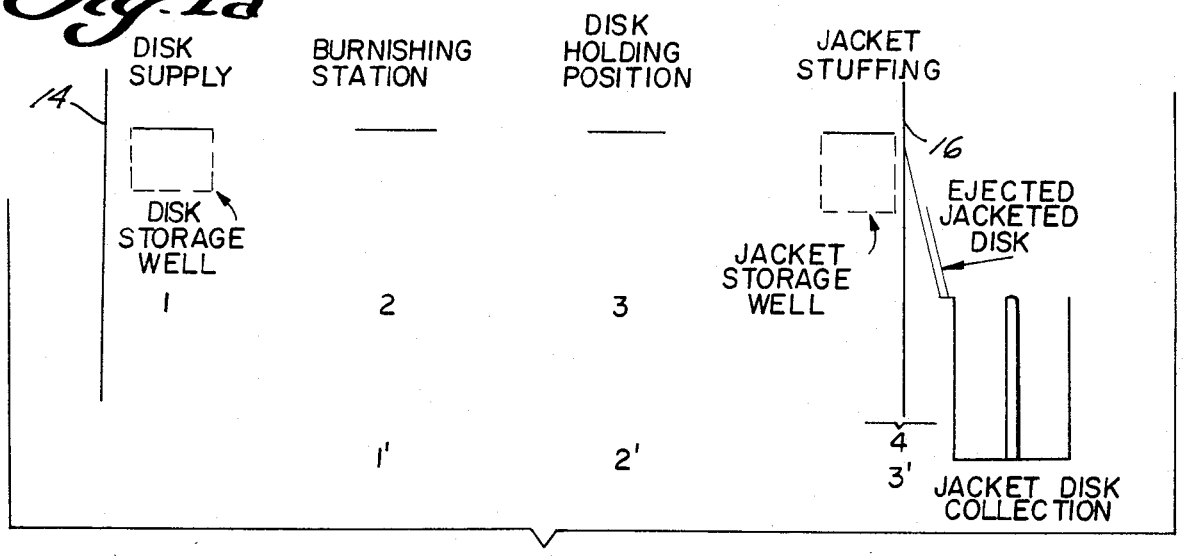
FIG. 1*a* is a diagrammatic representation of the positions through which a disk can be moved.

As explained above, there are four positions through which each disk will sequentially move with these being shown in FIG. 1*a*. In addition, there are three microswitches 172, 174 and 176 operated by movement of carriage assembly 22 that comprise part of the control system. The first position indicated by 1 correlates to the position of the disk within the stack of a plurality of disks in storage well 28. Position 2 corresponds to the position of the disk while in the burnishing station 32. Position 3 shows the relative position the disk when in its holding position, at a spot between the burnishing and jacket stuffing assemblies, with the disk supported at that point by the main support deck 36. The next position is, of course, within the jacket with the full carriage stroke also ejecting the jacket and the disk therein. When the carriage has been indexed or moved, numerals 1', 2' and 3', respectively, reflect the position of the new unburnished disk in the burnishing station, the just burnished disk now moved to the holding station 2' and the disk, formerly at position 3, now inserted into a jacket and ejected.

As shown in FIG. 1, the three limit switches 172, 174 and 176 are located along the path of travel of the carriage assembly 22 and will be actuated by tubular member 164. Switch 172 is positioned on side wall 20 and will be actuated by the rear of tubular member 164 when the carriage assembly 22 is in its full stroke position following jacket stuffing. Switch 176 is positioned just to the rear of the mid point of side wall 20 and is actuated when carriage assembly 22 returns to its home or initial position wherein the pick-up assembly 30 and transfer assembly 4 are respectively positioned adjacent the supply of disks and the burnishing station. Switch 176 is also positioned on side wall 20, but about five inches ahead of switch 174, so that it will be actuated subsequent to a predetermined amount of carriage movement and will cut off the vacuum being supplied to the vacuum pick-up pads 376 in the jacket stuffing assembly so that the jacket can be discharged.

TRANSFER ASSEMBLY

Figure 9:
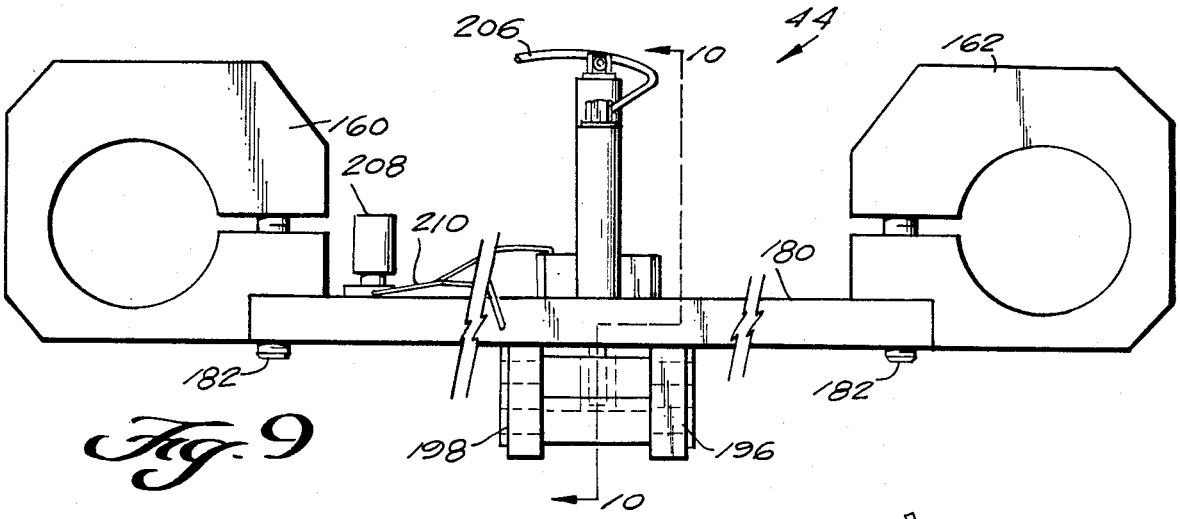
FIG. 9 is an end elevation of the transfer assembly.
Figure 10:
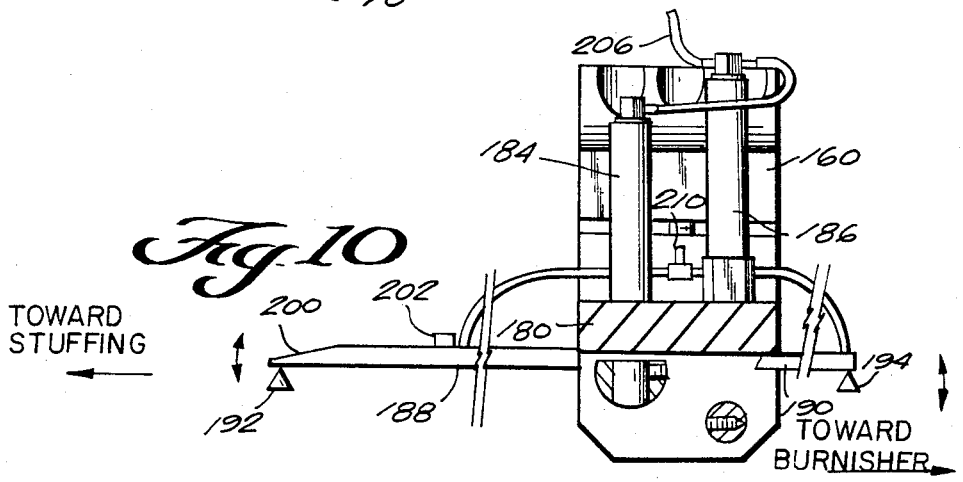
FIG. 10 is a diagrammatic, cross-sectional view taken along lines 10—10 in FIG. 9.

Transfer assembly 44, shown in FIGS. 9 and 10, includes a main mounting plate 180 to which rail mounts 160 and 162 are connected, such as by bolts 182. Air cylinders 184 and 186 are mounted to the top of plate 180 as shown and respectively control the raising and lowering of outrigger vacuum pick up arms 188 and 190 which support vacuum pick-up cups 192 and 194, respectively. Arm 188 is directed toward jacket assembly 34 while arm 190 is positioned in the opposite direction and has a length that will position it within burnishing assembly 32 but outboard of the disk clamp therein when coverage assembly 22 is in its home position.

With continuing reference to FIGS. 9 and 10, transfer assembly 44 has two mounting plates 196 and 198 depending from plate 180. Arms 188 and 190 are each pivotally connected between plates 196 and 198. Arm 188 is operatively connected to a drive arm 185 of cylinder 184 and in a like manner, arm 190 is connected to the drive arm of air cylinder 186 (not shown). Accordingly, cylinders 184 and 186 control the raising and lowering of arms 188 and 190 and thus vertical control over vacuum cups or pads 192 and 194.

In order to ease the insertion of disks into jackets, the front portion of arm 188 contains a beveled surface 200 which will easily slip under the top layer of the jacket. A stop 202 is provided farther back on the top of arm 188 for intersecting the jacket during the jacket stuffing operation but prior to completion of the carriage stroke. The remaining portion of carriage movement at that point will provide a sufficient push on the jacket so that the jacket will slide rearwardly out of the device through a discharge slot 374 in end wall 16 and into the discharge and collection means, generally indicated at 204.

Air cylinders 184 and 186 can be operated by air supplied via a supply line 206 and can have a spring return so that when air is released, arms 188 and 190 will raise to their normal horizontal position. Thus, the application of air will lower arms 188 and 190 into their disk contacting position. Likewise, vacuum will be supplied from the vacuum source 39 via a vacuum controller/sensor unit 208 and vacuum line 210 simultaneously to vacuum cups 192 and 194. Sensor 208 will generate a signal to the controller if vacuum is lost as, for example, would occur if a disk were not correctly picked up. The supply of air to cylinders 184 and 186 will occur following confirmation of the disk pick up, that is no signal from vacuum sensor 124, and the completion of burnishing time and jacket pick up and completion of the oscillation of plate 228. Then, arms 188 and 190 can be lowered and upon confirmation of vacuum pick up of the disks at the burnishing and holding stations, that is when sensor 208 does not generate a signal following actuation of arms 188 and 190.

BURNISHING ASSEMBLY

With reference now to FIGS. 2 and 11–18, the burnishing assembly 32 is mounted approximately half way between pick up assembly 30 and the jacket stuffing assembly 34.

Burnishing assembly 32 is comprised of a stationary portion, generally indicated at 220 and a reciprocating portion, generally indicated at 222. The stationary portion 220 includes the upper and lower tape burnishing assemblies, 234 and 236, respectively, and a support plate 235 spaced above and secured to deck 36.

Figure 14:
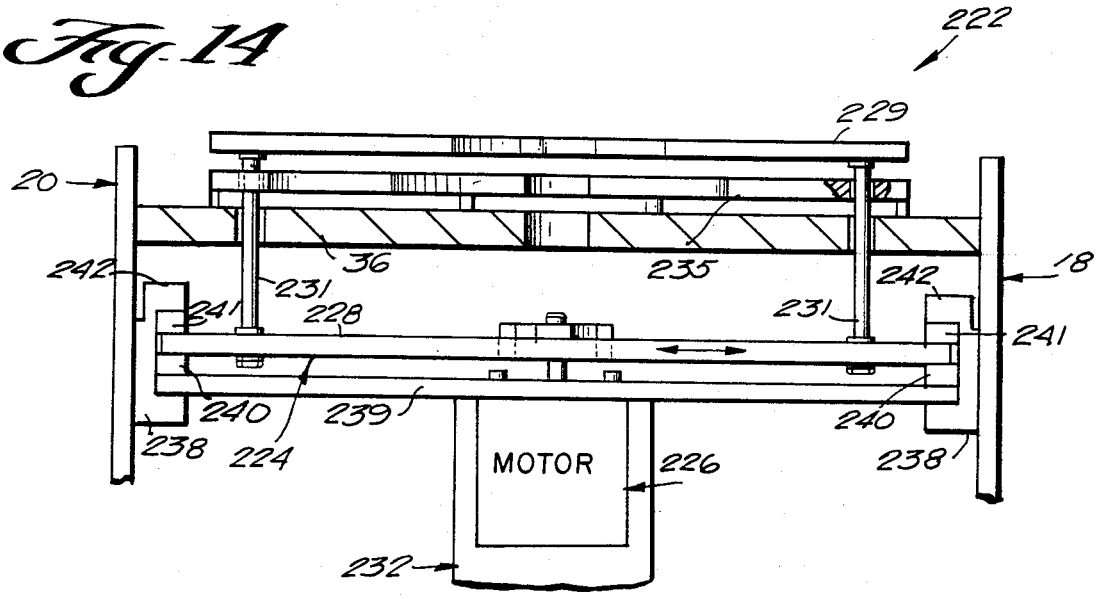
FIG. 14 is a front elevational view showing the slide mounting arrangement for the burnishing plate.

The reciprocating portion 222, includes a support assembly, generally shown at 224 in Figures 11–15, which supports a clamping assembly 230, a burnishinq motor 232 and a reciprocating drive motor assembly, generally indicated at 226 in FIG. 14.

Turning first to FIGS. 2 and 11–15, the reciprocating portion 222 moves the disks clamped thereby during burnishing, relative to the stationary burnishing assemblies 234 and 236, in order to increase the surface area being burnished and to improve the effects of burnishing by imposing a slight amount of back and forth travel to the disk as it rotates during burnishing.

With respect specifically to FIGS. 12, 13 and 14, support assembly 224 is comprised of a primary support plate 228, a top support plate 229 and four upwardly directed connecting posts 231.

Support plate 228 is mounted beneath deck 36 such that the end lying beneath pick-up assembly 30 can pivot. Its opposite end is positioned between the burnishing station and the jacket stuffing assembly and is supported so that it can slide back and forth between side walls 18 and 20 of the device. With reference to FIG. 12, plate 228 is provided with a plurality of openings indicated at 233*a*–233*e*. Opening 233*a* is provided to fit around a stationary bearing, indicated at 237 which constitutes the pivot connection. Opening 223*b* is sufficiently large to fit around well 28 in which the supply of disks are enclosed while opening 233*c* will provide a passageway through which the burnishing tape going to the lower burnishing roll 236 can pass through plate 228. The burnishing motor 232 is positioned below opening 233d and the reciprocating drive motor assembly 226 operates through opening 233*e*.

The end of plate 228, adjacent opening 233*e*, is supported by mounting brackets 238 which, in turn, are directly mounted to the side walls 18 and 20 of the frame. A support plate 239 which extends across the width of the machine is secured to brackets 238 and supports the reciprocating drive mechanism 226. Positioned at each end of plate 239, adjacent brackets 238, is a lower nylon slide bearing 240 on which plate 228 rests. An upper slide bearing 241 is provided on each side as well which is secured in place by a top bearing mount 242 so as to overlie and directly engage a similar portion of the sides at the end of plate 228 as do bearings 240. Thus, plate 228 is supported between the nylon slide bearings 240 and 241. As shown in FIG. 14, the width of plate 228, between the frame and brackets 238, is such that a gap is formed between the edges of plate 228 and the brackets so that plate 228 can move back and forth.

The eccentric drive which reciprocates plate 228 is provided by the reciprocating drive 226 in form of an electric motor 227 which preferably operates at a slow rate of about 72 rpm. Specifically, the motor's drive shaft 244 is provided with an eccentric portion over which is placed a roller bearing 243 with bearing 243 positioned between bars 245 and 246, which are positioned adjacent opening 233*e* and held to plate 228 by any convenient means such as bolts or screws. Accordingly, when the electric motor 227 is operated, shaft 244 and its eccentric portion will cause an eccentric motion to be transmitted to roller bearing 243. Since bearing 243 operates against bars 245 and 246, it will cause the forward end of plate 228 to oscillate back and forth, in a very slight arc, with the necessary pivoting action being provided by the connection about the rear bearing support 237. The eccentric portion of drive shaft relative to the roller or ball bearing has a radial eccentricity that can vary from about 0.030 to about 0.050 inches. As shown in FIG. 14, a microswitch 247 is mounted on plate 239 adjacent shaft 244 and is operated during each revolution by a cam 248. Switch 247 controls the turning off of motor 227 so that plate 228 will be centered at the end of each burnishing sequence as will be explained hereinafter.

As shown in FIG. 14, relatively large openings are provided in deck 36 and support plate 235 for columns 231 which secure an upper mounting plate 229 to plate 228. Thus, as plate 228 is reciprocated, columns 231 and the top mounting plate 229 all reciprocate together.

With reference to FIGS. 11, 17 and 18, clamping assembly 230 is comprised of an air cylinder 250 having its air supply controlled by a conventional electronic value, fixed to the upper mounting plate 229, having an upper clamp member 252 mounted to the drive arm thereof. Lower clamp member 254 fits over the drive spindle 256 of burnishing drive motor 232. Each contains a urethane washer 251 about their clamping surfaces and as in FIG. 18, the upper clamp includes an inwardly tapered centering member 253 for more positively centering a disk therebetween. The lower clamp member 254, when positioned over spindle 256, will remain vertically stationary with respect to upper member 252 which is connected to the drive arm 258 of air cylinder 250 and accordingly can be raised and lowered to permit entry and exit of disks when raised and to clamp them when lowered. As will be seen in FIG. 9, a gap generally indicated at 260 is provided between the bottom of plate 242 and deck 36 to permit passage of disks through the burnishing station. Since the type of oxide or other coating being burnished, as well as the substrate of the disk, and the type of burnishing tape are all variable, it is preferred to have the rpm rate for burnishing motor 232 adjustable. Accordingly, suitable conventional control can be provided to adjust the rpm burnishing speed of motor 232 to develop a desired result. The preferred rpm rate is about 3000 rpm for a four second burnishing time.

Operation of the burnishing assembly is preferably under the control of a plurality of timers which can operate together or sequentially. The operation sequence begins by actuating the clamping mechanism which preferably occurs when carriage assembly 22 is at its full stroke position. At this point, the disk on roll 84 will have been moved directly within the burnisher with the central opening being directly over the clamp. In order to assure that will occur, drive shaft 244, oscillator motor 227 is provided with a cam 248 that will operate microswitch 247 on each revolution. Oscillator motor 227 operates at a slow 72 rpm rate and revolutions are counted during the burnishing cycle so that when burnishing is completed, usually within about 4 seconds, the next revolution and contact between cam 248 and switch 247 will stop motor 227. This will assure the oscillation terminates so that oscillation plate 228 is centered between side walls 18 and 70. This likewise centers the burnishing unit and its clamp assembly 230. During 4 seconds the oscillation motor 227, at 72 rpm, will rotate about five times. Thus, some additional amount of rotation of drive shaft 244 may occur following the stopping of burnishing motor 232, but less than one full revolution will be needed, however, to center the eccentric drive between bars 245 and 246.

It should be understood that the burnishing sequence could be started later than when microswitch 176 is actuated but it is desirable to clamp the disk being transferred from the supply stack as quickly as possible and it is most convenient to turn off the vacuum to roller 84 and subsequently actuate clamping assembly 230 to sensing the full stroke of carriage assembly 22.

BURNISHING TYPE ASSEMBLIES

Figure 15:
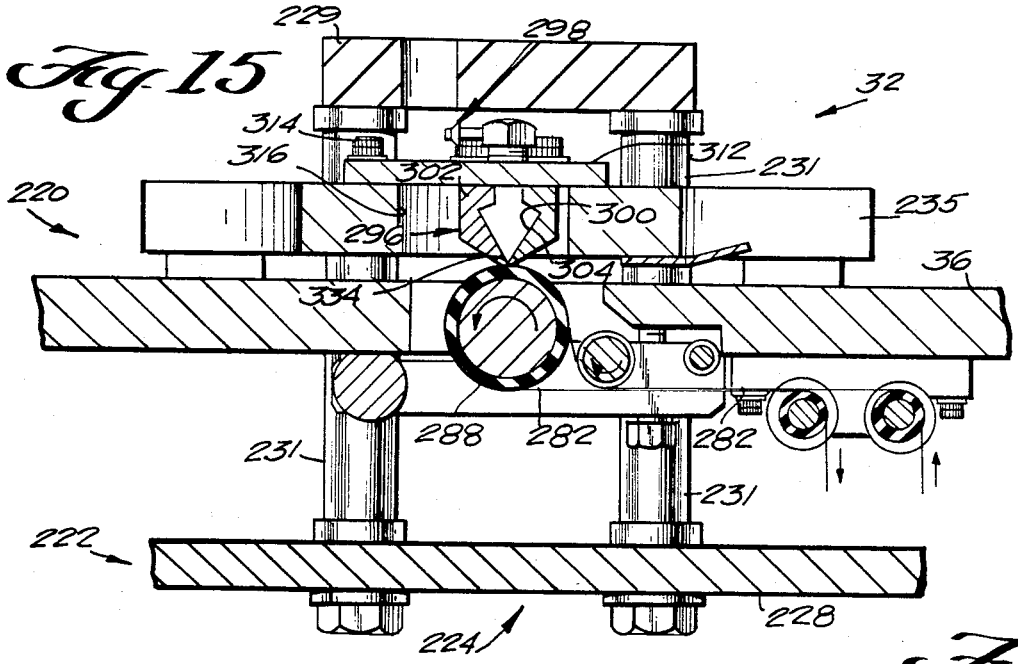
FIG. 15 is a diagrammatic elevation with portions in cross-section taken along lines 15—15 in FIG. 2.

With reference to FIGS. 2, 15 and 16, the upper drive roller assembly 234 is comprised of a tape supply reel 270 for burnishing tape 272 and a take up reel 274. Burnishing tape 272 after leaving supply reel 270, will pass over a series of guide rollers 276 which direct the tape toward burnishing roller 278 with transport back to take up reel 274 being via a second series of rollers 280. A tape tension sensing microswitch 273 is positioned just downstream from supply roll 270 in order to continuously monitor the preferred tape tension and presence of that burnishing tape. If that tape is not sensed then the processing sequence will be shut down.

In a similar manner, the second burnishing tape 282 is fed from tape supply reel 284 via a series of guide rollers 286 to burnishing roller 288 and returns to the take up reel 290, having passed through opening 233*c*, via a second series of guide rollers 292. A separate and second tape tension sensing microswitch 283, as shown in FIG. 16, is positioned just downstream from supply reel 284 and operates as does switch 273 described above.

Figure 5:
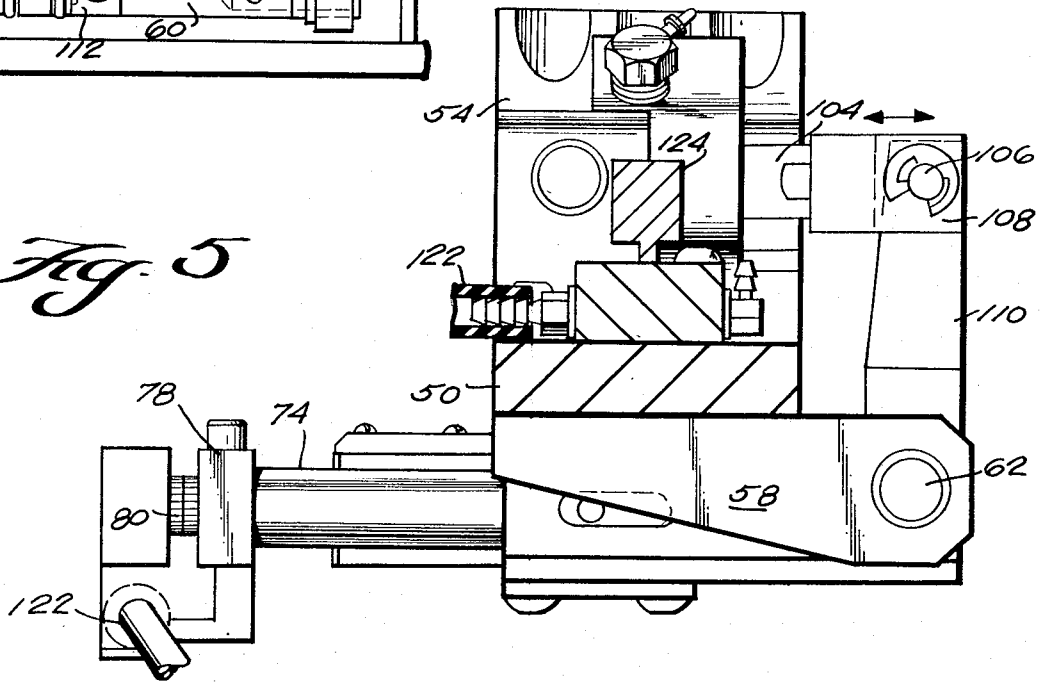
FIG. 5 is a cross-sectional view taken along line 5—5 of FIG. 4.

Each of the burnishing assemblies 234 and 236 also include air hold down apparatus for holding the disk against the burnishing rollers 278 and 288, respectively referred as air knives 294 and 296, with the air knives being best shown in FIGS. 15–17. As shown in those Figures, each air knife hold down is provided with an air supply connector 298 which leads into an internal chamber 300. As indicated in FIG. 5, air chamber 300 has a tapering cross-section defined by two identical sections 302 and 304, with one being shown in detail in FIG. 15*a*. Two end walls 306 and 308 are attached by screws 310 and sections 302 and 304 with end walls 306 and 308 in place are then secured to a mounting plate 312 which is itself conveniently secured to the device. Specifically, the upper air knife 296 is secured to mounting plate 235 and within an opening 316 by bolts 314 while the bottom air knife would be similarly secured to deck 36 within another suitable opening therefor.

Figure 15A:
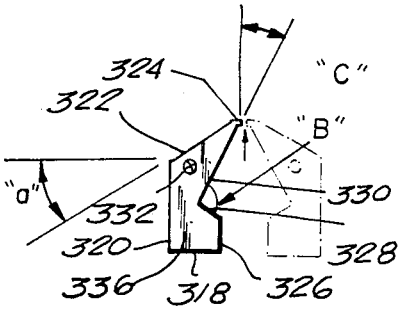
FIG. 15*a* is a detailed view of one side of the air knife air chamber housing.

With reference to FIG. 15*a*, each main section 302 and 304 includes a mounting surface 318 and an outer vertical wall 320 which changes into a sloping wall 322 and terminates, substantially perpendicular to surface 318, along one edge of a flat bottom foot 324, that is substantially parallel with surface 318. Sloping wall 322 is at an angle "a" from the horizontal of approximately 30° and the flat bottom foot 324 has a width of about 0.075 inch. The interior chamber is specifically defined by a vertically extending interior wall 326 and two angled interior walls 328 and 330 which define an angle "b" between them of about 90°. Wall 330 terminates along the opposite edge of the flat foot surface 324 and is at an angle "c" from vertical of about 30°. A hole 332 is provided in each end wall 336 to receive screws 310 for mounting end plates 306 and 308.

As exemplary dimensions of this section surface 318 has a width of about 0.350 inch, interior wall 326 is about 0.250 inch long and the overall height from foot 324 to surface 318 is about 0.870 inch. The width from surface 320 to the juncture of foot 324 and interior wall 330 is about 0.500 inch, and the length from one end to the other is about 1.400 inches.

When sections 302 and 304 are formed together with the respective end and mounting plates an enclosed interior cavity is formed that is relatively large when compared to the elongated gap or slot 334 that is also formed between the two opposing foot positions and from which the air will exit through the disk. The small gap defined thereby has a relatively large air flow area behind it, defined by the interior of sections 302 and 304, end walls 306 and 308 and mounting plates 312, so that a relatively constant flow of air is generated when air is directed to the air knives.

It is preferred to provide a polished exterior surface for the air knives in order to prevent any damage to disks that may touch them and to smooth out the air flow passing thereover. The outer surfaces of the air knives, after polishing, could be nickel plated or microsealed through a process employing graphite to produce the desired smooth exterior finish.

As is perhaps best clear from FIG. 16, each air knife lies directly opposite a burnishing roller 278 or 288. Disks have a thickness that can vary from about 0.0030 inch to about 0.0035 inch and in order to develop sufficient air flow to hold the disks firmly against the burnishing tape the air knife orifice slot is preferably spaced about 0.0080 inch above the tape. This spacing is for an orifice slot dimensioned to have a width of about 0.007 to 0.008 inches and about 1.4 inches in length and with air pressure ranging from about 15 to 30 pounds with the preferred air pressure varying from 20–22 pounds. If too little air escapes from the area between the air knife and the disk either because of too small a space or too much air pressure, the disk will be held too tightly and the burnishing process will crinkle the disk. Conversely, if the air pressure is too low or if the spacing is too great between the air knife and the disk, then too much air will escape and burnishing will not be as effective.

Figure 15B:
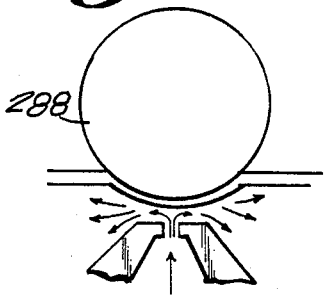
FIG. 15*b* is an enlarged view of the exit of the air knife showing the effects of the air and the exit slot construction to enlarge the contact area between the disk and burnishing tape.

It should be noted that when assembled, each air knife will have its orifice defined between the two flat foot surfaces 324 and the endwalls 306 and 308. Air exiting from orifice slot 334 will initially pass over the flat surfaces 324 and the disk itself. The air will then be released outwardly along sloping surfaces 322. The flat surfaces 324 cooperate to not only assure the absence of any low pressure area above the disk during burnishing but also provide an air flow that will cause the disk to slightly wrap about a greater portion of the burnishing roller's circumference resulting in an enlarged contact area between the disk surface and the burnishing tape passing around the burnishing roller. This is shown in FIG. 15*b*. Thus, a greater degree of disk to tape contact will be created by this partial wrap. The air flow from the air knives not only produces holding pressure directly opposite the discharge orifice but also along the extent of surfaces 324.

Thus, as shown in FIG. 17, when a disk 130 is held between clamping members 252 and 254, the air knives 294 and 296 simultaneously supply an air flow against the opposite sides of the disk so that the associated burnishing tape will burnish its side uniformly and without any engagement or friction between the disk and the air knives. The amount of air pressure is adjustable and air flow is initiated preferably by a timer controlled value (not shown) that will prevent air flow until the burnishing motor has been on a sufficient time to get up to speed. Also, the air will be applied for the burnishing time, preferably about 4 seconds.

The burnishing tape reels preferably hold 600–1200 feet of burnishing tape which themselves can be comprised of either a plastic or paper tape material on which a very fine grit, such as 1 million grit, is used. Burnishing tapes are used once and then discarded and are fed at a rate so that during a four second burnishing cycle about ¼ of an inch of tape is fed over the burnishing rollers.

JACKET STUFFING ASSEMBLY

Figure 19:
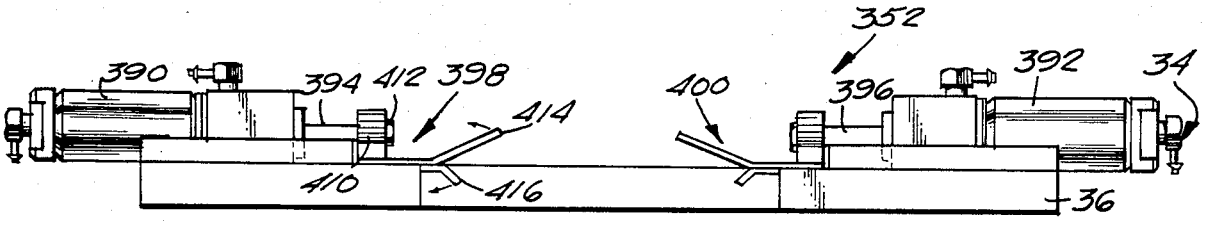
FIG. 19 is a diagrammatic end elevation of the jacket stuffing assembly as shown in FIG. 2.
Figure 20:
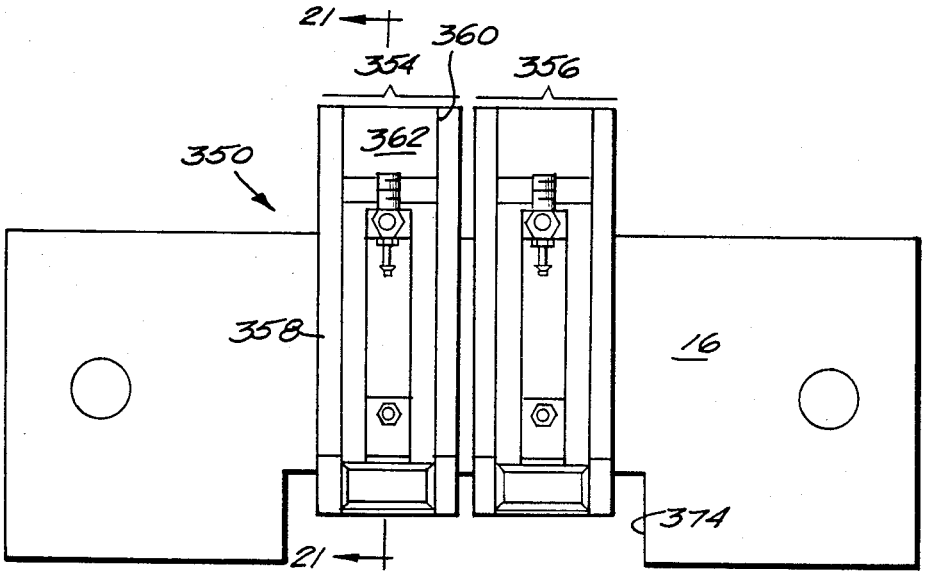
FIG. 20 is a diagrammatic end elevation of the side wall of the frame adjacent the jacket stuffing assembly.
Figure 21:
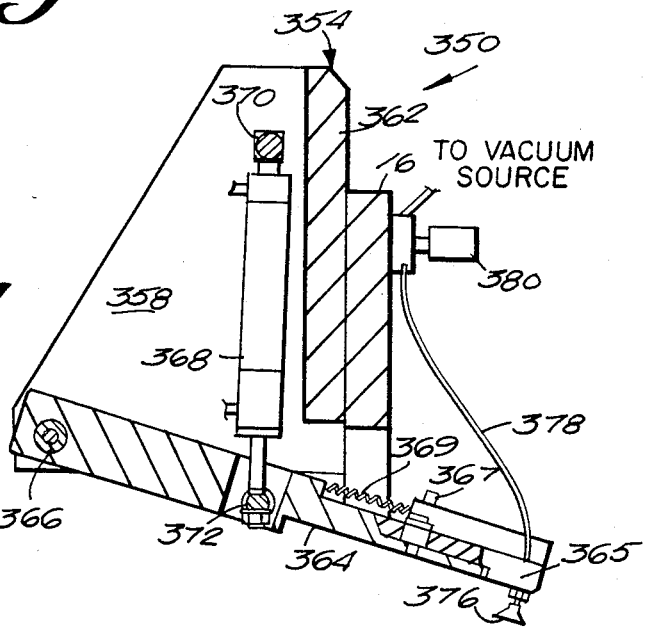
FIG. 21 is a diagrammatic cross-sectional view taken along lines 21—21 in FIG. 20.

With reference now primarily to FIGS. 2 and 19–21, the jacket stuffing assembly is comprised primarily of an envelope lifting device, generally indicated at 350, shown primarily in FIGS. 20 and 21, as well as a jacket centering and opening assembly, generally indicated at 352 and shown primarily in FIGS. 2 and 19.

The jacket lifting device 350 is comprised of two identical lifting assemblies 354 and 356. Since these are identical only one will described in detail with FIG. 21 being a cross-sectional view taken through part of the unit. Lifting assembly 354 includes a pair of mounting plate, 360 and a vertically extending joining plate 362 which is mounted to frame wall 16. An arm or lever 364 is pivotally connected by means of a 366 between plates 358 and 360 and an air cylinder 368 is pivotally attached by a mounting structure 370 to the lifting assembly 354 and by a ball joint connection 372 to lever 364. The air supplied to air cylinder 368 is preferably under the control of a timer. The cylinder can have two air supply inlets so that air flow thereto can be reversed or the cylinder can have a spring return, in which case air will be supplied or not in order to control the lowering and raising of arms 364.

This discharge opening 374 is provided in wall 16 and it is through that opening that levers 364 can be raised or lowered and through which the stuffed jackets will be discharged. Each lever 364 includes an articulated front member 365 joined to lever 364 by a pivot connection 367 and spring 369. A vacuum pad 376 is attached to the outer end and on the bottom surface of member 365 and is connected to the source of vaccum 39 by vacuum line 378 through a suitable vacuum controller and sensor 380 which will generate electrical control signals which will go to the controller. Each of the levers 364 has sufficient vertical motion to allow the vacuum pads 376 to engage the topmost jacket in a stack provided in a well 382 adjacent wall 16 and to vertical lift that topmost jacket a predetermined distance off that stack. The supply height of the stack of a plurality of jackets is controlled by a pair of electric eyes 426 which, in a manner similar to the height control for the disks controls a motor and a pair of vertically and rotatably mounted threaded shafts on which a jacket support platform is movably attached.

Figure 22:
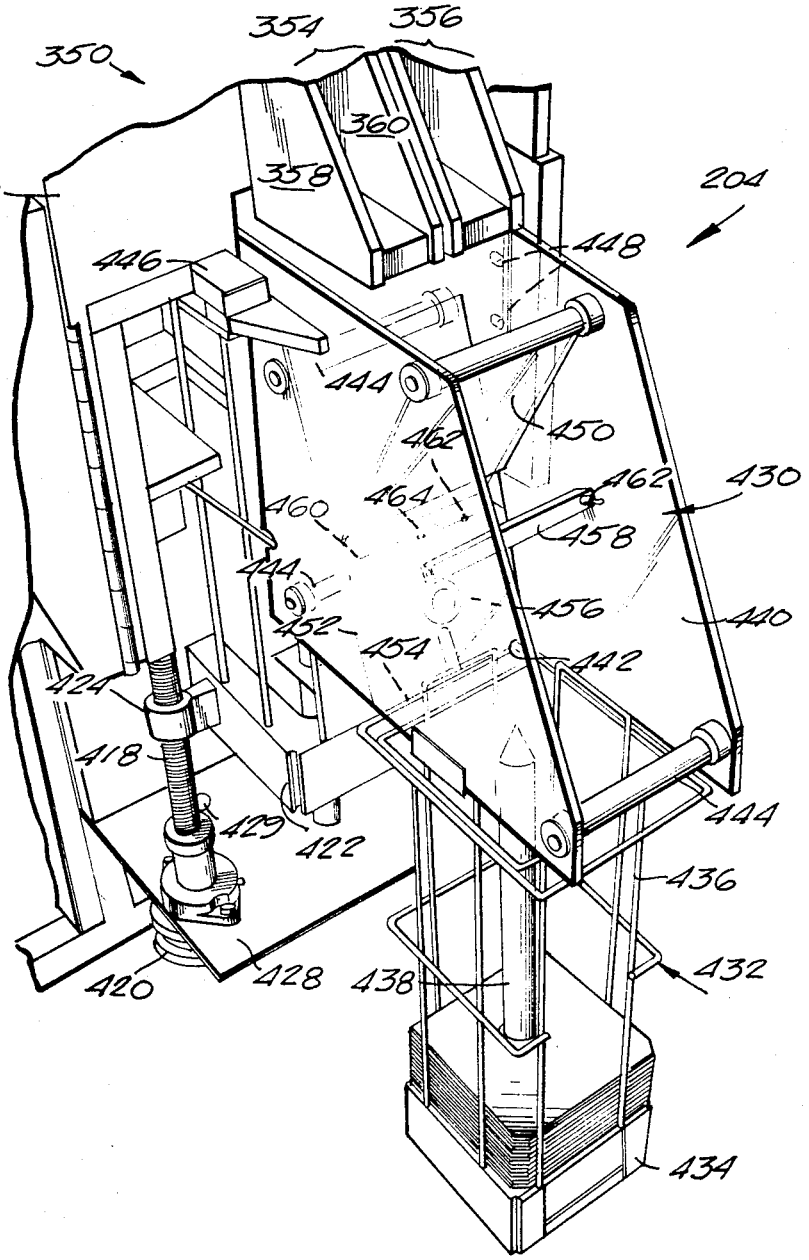
FIG. 22 is a perspective view of the collection assembly.

With reference to FIG. 22, one of the threaded shafts 418 is shown extending vertically above a drive motor 420 with both secured to a support plate 428 itself attached to the main frame. The other threaded shaft, on the opposite side of the jacket carrier 422, can be drivingly connected to motor 420 by a belt (not shown) or by any other convenient means and jacket carrier or elevator 422 is connected to both threaded shafts 418 by a complementary threaded mount 424 that will permit carrier 422 to be raised and lowered as shafts 418 are rotated clockwise or counterclockwise. Thus, a stack of empty envelopes or jackets can be placed in carrier 422 and when the burnishing machine is turned on, the electric eyes 426 will actuate motor 420 driving shafts 418 clockwise to elevate or raise carrier 422 and the jackets therein until the jackets interrupt the light beam thereby deactivating motor 420. The supply height as controlled by the electric eyes will be such that levers 364 can easily bring vacuum pads 376 into engagement with the top jacket. A microswitch 429 will control the bottom or lower position of carrier 422 with switch 429 being tripped by the carrier when it reaches the predetermined lower position to turn off motor 420.

Deck 36 also includes a lip 384 which extends from the front periphery of the jacket storage well outwardly into that well to a position overlying end flaps 386 of the jackets. As a jacket is lifted vertically off the stack, lip 384 will engage the jacket lip 386 which will accordingly be held thereby. Continued raising of the levers 364 will further raise or lift only the top layer of the jacket so that lip 384 will cause the jacket mouth to open.

With reference now to FIGS. 2 and 19, the jacket centering and opening assembly 352 is comprised of a pair of air cylinders 390 and 392 each respectively fixed to deck 36 by any convenient means. Each also includes a drive arm 394 and 396 and a centering mechanism 398 and 400 each respectively connected to drive shafts 394 and 396. Slide plate assemblies 398 and 400 are in all respects identical albeit each approaches the jacket from opposite sides. Accordingly, only one centering mechanism 398 will be further described.

A pair of guides 402 are mounted to mounting plate 36 by screws 404 and serve to guide the edges of a slide plate 406 provided with a U-shaped opening 408 which can fit about air cylinder 392. A mounting bracket 410 serves as the mounting mechanism for securing plates 406 to drive shaft 394 by bolts 412. The front portion of plate 406 is comprised of a top, upwardly angled member 414 and a lower downwardly angled member 416 with each diverging away from the point at which they meet so that a substantially V-shaped opening is defined therebetween. As shown, the top member 414 extends outwardly farther than does the angled portion of the lower member 416 so that jackets can pass between the two lower members when they are fully retracted but not the upper members which in fact engage the sides of the top layer as shown in FIG. 2.

When jacket 388 has been raised to the point that the front edge 386 contacts lip 384 so that the jacket begins to open by continued vertical movement of levers 364, air cylinders 390 and 392 will have been actuated causing the members 414 and 416 in each of the slide plate assembly to move inwardly toward the center of the jacket. Thus, once the jacket has been raised past lower members 416 and through the opening defined thereby, cylinders 390 and 392 can be actuated moving the slide plate assemblies inwardly. The jacket will be gripped by the V-shaped opening and the angled members assist in appropriately opening the jacket. Further, the inward movement of the slide plate assemblies serves to center and hold the jacket firmly enough so that the disk can easily slid therein but not so firmly that the jacket cannot be easily discharged by stop 202 following disk insertion.

The vacuum supply to vacuum pads 376 is turned off by the carriage assembly 22 when switch 176 is opened as the carriage assembly moves toward its full stroke position. Thus, the jacket at that point will continue to be held only between the slide plate assemblies from which it can be ejected. The slide plate assemblies themselves will be actuated to move inwardly by a suitable timer whose timing cycle will be initiated, as will that of the air supplied to air cylinders 368, by switch 176 when it is again closed as carriage assembly 22 returns to its home position. The air supply to cylinder 368 will be reversed, or turned off if a spring return type cylinder is used, following confirmation by sensors 380 that a jacket is correctly engaged by the vacuum pads 376. The closing of switch 176 can also return the slide plate assemblies to their home positions.

Opening 374 in rear wall 16 leads directly to a discharge and collection assembly, generally indicated at 204 in FIG. 22, and as indicated previously once the disk is inserted into the envelope, stop member 202 on vacuum arm 188 will engage the front edge of the upper layer of the open jacket 388 causing the jacket to slide through mechanisms 398 and 400, through discharge opening 374 and out of the machine to be collected.

DISCHARGE AND COLLECTION ASSEMBLY

With reference now to FIG. 22, the discharge and collection assembly 204 is comprised of a discharge chute, generally indicated at 430, and a collection container, generally indicated at 432. The latter is comprised of a base 434 and an open framed receptacle 436 supported thereby. Positioned centrally within collection container 432 is a guide tube 438 having a rounded or sharpened end over which the open center of the jacketed disks can slide and be guided for collection purposes.

Discharge chute 430 is comprised of two sides in the form of plexiglass sheets 440 and 442 which are held in a spaced apart condition by a number of separators 444 and by a front sheet or inner panel 452. A mounting bracket 446 is secured to wall 16 or the main frame by any convenient means such as bolts (not shown) with the plexiglass sheets 440 and 442 being secured to brackets 446 by bolts 448.

A deflection plate 450 is also secured between plates 440 and 442 at a downwardly deflected angle in order to deflect jackets being discharged from the burnishing machine toward inner panel 452. A stop 454 is provided across the bottom of inner panel 452 so that the deflected jackets will slide down panel 452 until each is stopped by stop 454. An envelope in such a position is shown in phantom in FIG. 22 at 456. A pair of crossbars 458 and 460 are provided on the front and rear of the discharge chute 430, and serve to support a pair of electric eyes 462. In addition, bar 460 supports an air nozzle 464 connected through an activator under the control of the electric 462 to a suitable source of air. As shown, when an envelope 456 is within the chute and stopped against stop 454, the upper portion of the envelope will interrupt the beam passing between electric eyes 462 and overlie the air nozzle 464. When the beam is cut the air supply to nozzle 464 is activated which will in turn blow the top part of the jacket forward so that the bottom will pivot about to stop 454. When the envelope has pivoted to a horizontal position, its open center will be approximately positioned over guide tube 438 after which it will then drop down along tube into the open frame receptable 436.

Collection container 432 will be positioned beneath discharge chute 430 as shown in FIG. 22 so that it will be below the discharge opening of that chute defined between sheets 440 and 442, the bottom of plate 452 and the lowermost separating bar 444.

Figure 23:
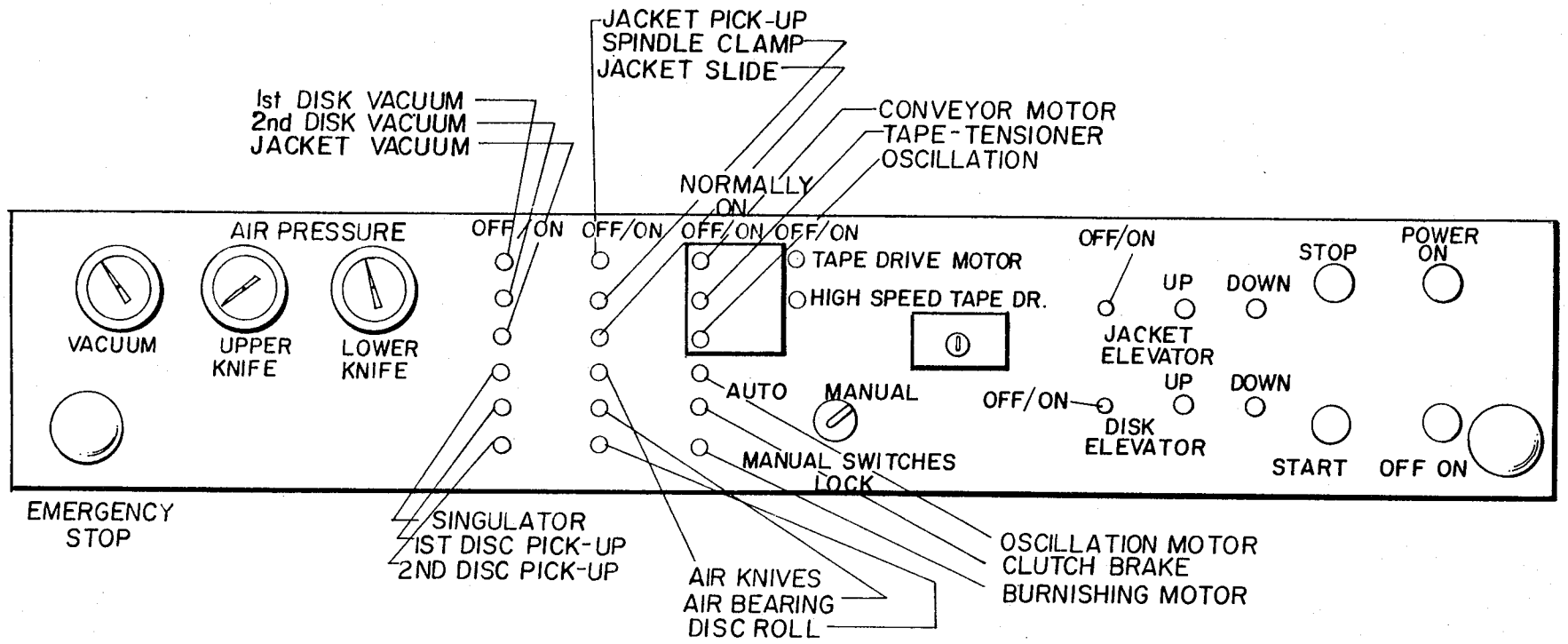
FIG. 23 is a diagrammatic view of the control panel of the burnisher.

FIG. 23 sets forth an exemplary control panel for the burnishing machine described hereinabover and is exemplary of the various types of manual automatic controil that can be employed. As previously stated, it is preferred to have the operation of this machine under the control of an on board conventional microcomputer or controller which can monitor inputs from the various timers, limit switches and vacuum sensors in order to continuously monitor the progress of each activity being undertaken at each one of the various operating stations and to assure disks are properly picked up and that the preset timing cycles are completed prior to initiating subsequent processing. If, for any reason, the vacuum pickups do not correctly pick up a disk or a jacket, one of the vacuum sensors associated with that vacuum pad or pickup will sense that condition and stop the machine to allow the operator to investigate and correct the problem. Likewise, it is essential for the carriage to move unimpeded throughout its full stroke and if a blockage occurs, the carriage drive will also stop the machine. The panel shown in FIG. 23 sets forth exemplary items that can be used to provide suitable control. Also, various other operation sequences can be employed other than those set forth above, it only being essential to complete the engaging of disks at the various pick up points and burnishing and jacket preparation prior to moving the carriage assembly and subsequent similar cycles.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. A device for burnishing floppy disks, said device comprising:

a frame;

means mounted on the frame for supporting and rotating the disks;

a first burnishing roller mounted on the frame and positioned relative to the disk supporting means so that the roller will lie proximate a disk mounted on said supporting means, said roller being capable of receiving a burnishing tape and supporting said tape to contact the disk;

an air nozzle directed at and spaced-apart from the first burnishing roller so that an air stream emerging from the nozzle will urge a disk mounted on the supporting means against the burnishing tape on the roller; and means for directing an airstream through the nozzle.

2. A device as in claim 1, further comprising:

a second burnishing roller mounted on the frame and positioned relative to the disk supporting means so that the second roller will lie proximate a disk mounted on the supporting means and on the opposite side of the disk as the first burnishing roller, said second roller being capable of receiving a burnishing tape and supporting said tape to contact the disk; and a second air nozzle directed at and spaced-apart from the second burnishing roller so that an air stream emerging from the second nozzle will urge a disk mounted on the supporting means against the burnishing tape on the second roller.

3. A device as in claim 2, wherein the disk support and rotating means includes means for translating the disk relative to the burnishing roller so that the burnishing tape contacts the entire useful area of one side of the disk as the disk is rotated.

4. A device as in claim 2, further including means for advancing the burnishing tape over the burnishing roller as the disk is rotated.

5. A device as in claim 2, wherein the air nozzle has an elongate slot for directing the airstream therefrom, said air nozzle being mounted on the frame so that the slot is axially aligned with the burnishing roller and positioned so that the airstream causes the disk to contact the roller along a line which is radial to the disk and tangential to the roller.

* * * * *